US007584639B2

(12) United States Patent
Boltshauser

(10) Patent No.: US 7,584,639 B2
(45) Date of Patent: Sep. 8, 2009

(54) METHOD AND DEVICE FOR THE PRODUCTION OF A CAN BODY, AND CAN BODY

(75) Inventor: Werner Boltshauser, Bütschwil (CH)

(73) Assignee: Crebocan AG, Buetschwil (CH)

( * ) Notice: Subject to any disclaimer, the term of this patent is extended or adjusted under 35 U.S.C. 154(b) by 107 days.

(21) Appl. No.: 10/562,035

(22) PCT Filed: Jun. 17, 2004

(86) PCT No.: PCT/CH2004/000368

§ 371 (c)(1),
(2), (4) Date: Aug. 4, 2006

(87) PCT Pub. No.: WO2005/000498

PCT Pub. Date: Jan. 6, 2005

(65) Prior Publication Data

US 2007/0177962 A1 Aug. 2, 2007
US 2009/0003972 A9 Jan. 1, 2009

(30) Foreign Application Priority Data

Jun. 27, 2003 (CH) ..... 1140/03
Jan. 15, 2004 (CH) ..... 0054/04

(51) Int. Cl.
*B21D 51/26* (2006.01)

(52) U.S. Cl. ..... 72/379.4; 72/58; 413/2; 413/3; 413/4; 413/26; 413/69; 413/74; 220/612; 220/678; 29/429; 29/773

(58) Field of Classification Search ..... 413/1, 413/2, 3, 4, 26, 52, 55, 69, 70, 72, 74, 77; 29/429, 469, 564.1, 773, 781, 33 R; 219/604, 219/61.11; 228/13, 160; 72/361, 57, 58, 72/370.14, 370.23, 379.4, 370.06; 220/610, 220/612, 678, 679, 680
See application file for complete search history.

(56) References Cited

U.S. PATENT DOCUMENTS 244,465 A 7/1881 Loomis et al.

(Continued)

FOREIGN PATENT DOCUMENTS

DE 14 52 556 A 4/1969

(Continued)

OTHER PUBLICATIONS

International Search Report.

*Primary Examiner*—Jimmy T Nguyen
(74) *Attorney, Agent, or Firm*—Harness, Dickey & Pierce PLC

(57) ABSTRACT

The aim of the invention is to produce can bodies (24') comprising a can shell (24) and a closing element (31*b*, 32, 31*a*) that is fixed to one face of the can shell (24). Said aim is achieved by producing a tube (11) from a metal strip (1), optionally from directly adjacent sections (112), by means of a shaping step, at least one optional cutting step, and a continuous welding step, sections of said tube (11) being used as closed convex surfaces for cans. The sections are shaped by a shell-shaping device in such a way that can shells (24) are provided into which a closing element (31*b*, 32, 31*a*), especially a can bottom (31*b*), can be inserted. The longitudinal seam (11*a*, 124) can be produced inexpensively and at great precision essentially as a continuous seam in the welding step by means of simple installations.

30 Claims, 13 Drawing Sheets

U.S. PATENT DOCUMENTS

| | | | | | |
|---|---|---|---|---|---|
| 3,337,944 | A | * | 8/1967 | Morris | 29/413 |
| 3,526,186 | A | * | 9/1970 | Cornelius | 426/398 |
| 4,095,544 | A | | 6/1978 | Peters et al. | |
| 4,199,851 | A | | 4/1980 | Doherty | |
| 4,315,132 | A | * | 2/1982 | Saurin et al. | 219/121.64 |
| 4,341,943 | A | | 7/1982 | Nilsen | |
| 4,905,858 | A | * | 3/1990 | Budenbender | 220/612 |
| 5,186,592 | A | | 2/1993 | Buedenbender | |
| 5,997,232 | A | * | 12/1999 | Sauer | 413/1 |
| 6,389,866 | B1 | * | 5/2002 | Radtke | 72/336 |

FOREIGN PATENT DOCUMENTS

| | | | |
|---|---|---|---|
| DE | 24 56 097 | | 6/1975 |
| DE | 197 16 079 | A1 | 4/1998 |
| DE | 198 34 400 | C1 | 1/2000 |
| EP | 0 200 098 | A2 | 11/1986 |
| EP | 0 208 564 | A | 1/1987 |
| EP | 0525 729 | A1 | 2/1993 |
| EP | 0 666 124 | B1 | 8/1995 |
| EP | 0 853 513 | B1 | 7/1998 |
| EP | 0 853 514 | B1 | 7/1998 |
| EP | 0 853 515 | B1 | 7/1998 |
| EP | 1 153 837 | A | 11/2001 |
| WO | WO 02/02257 | A1 | 1/2002 |
| WO | WO 02/92466 | A1 | 5/2002 |
| WO | WO 02/42196 | A2 | 11/2002 |
| WO | WO 2005/068127 | A2 | 1/2005 |

* cited by examiner

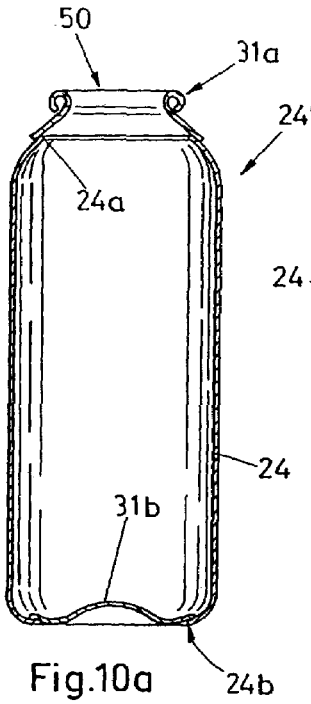
Fig.10a
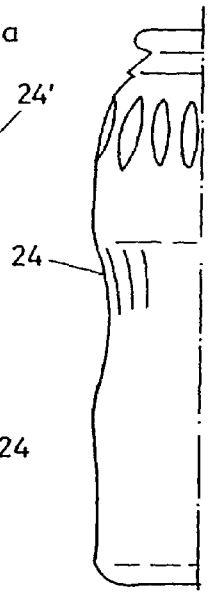
Fig.10b
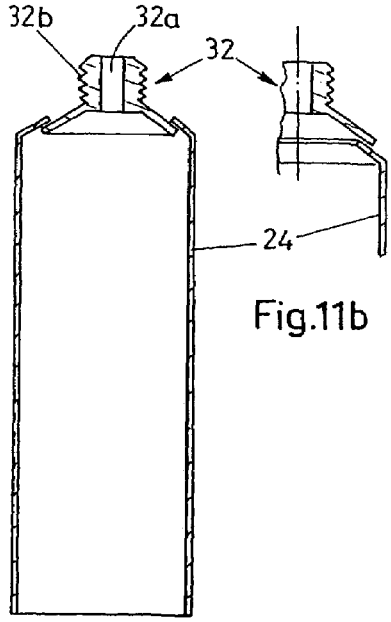
Fig.11b
Fig.11a
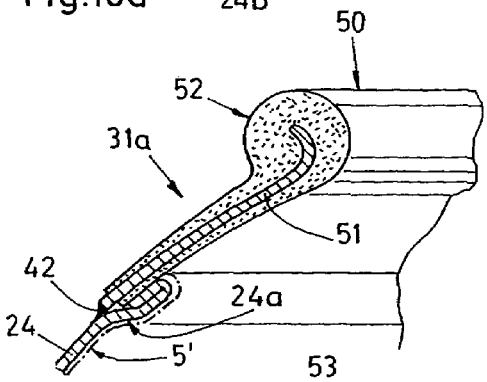
Fig.12
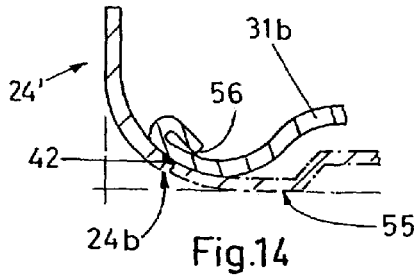
Fig.14
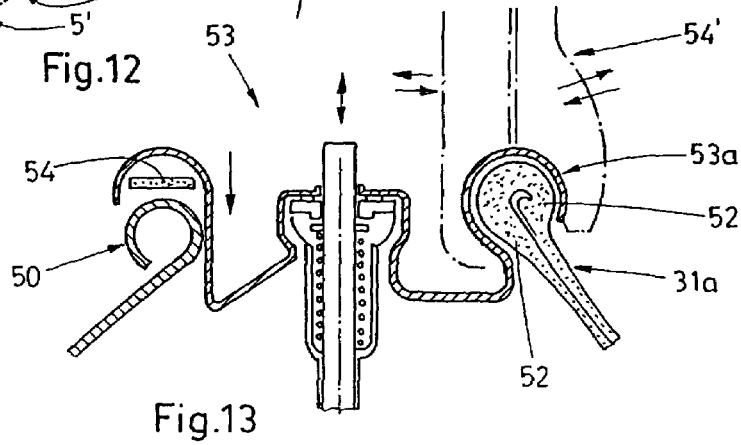
Fig.13

METHOD AND DEVICE FOR THE PRODUCTION OF A CAN BODY, AND CAN BODY

The invention relates to a process for producing a can body, a process for producing a can body with a closed shell and at least one closure member arranged on the can shell.

BACKGROUND

Container having metal walls and/or shell and bottom, particularly aerosol cans having a decoration, are formed either of one part or of several parts. In the case of one-piece aerosol cans of aluminum, the cylindrical can body is provided by cold sinking. Subsequently, a valve seat is formed at the open end by means of an upset necking procedure. This process of production is very expensive due to the installation required for the bulk of treatment steps as well as for the requirements regarding water and energy for cleaning and drying. U.S. Pat. No. 4,095,544 and EP-0 666 124 A1 describe the production of seamless steel cans. There, a cylindrical can body is manufactured from a steel sheet coated with tin or plastic material by punching, pressing and ironing. It turned out that enormous problems occur with forming restricted neck portions, because the material's structure is changed and hardened by ironing. Very current are also cans of steel sheet where the shell has a longitudinal welding seam. The bottom and the upper closure are fastened to the shell by folded seam connections. With folded seam connections sealing problems may occur which, for example, are reduced by sealing rings. Problems result also in the current extremely thin-walled cans with sealings that are arranged on the end face. From documents EP 200 098 A2 and EP 208 564, two-piece or multipart cans are known where the parts are interconnected by laser welding. The shape of the cans given by the known laser welding seams in the interconnection zones between the can's wall and the bottom or valve seat are not attractive and, moreover, a cost-effective production of sufficiently high piece numbers per time unit cannot be achieved with the known process. The above-mentioned longitudinal welding seams, particularly the longitudinal welding seams known from U.S. Pat. No. 4,341,943 too, have small steps or differences in thickness in peripheral direction which lead to problems at the can body when necking the neck portion, and to an elevated load of the necking tools.

From WO 02/02257 A1, a process for forming a neck portion is known where a deforming surface cooperates with a propping surface in such a manner that the can's wall is deformed between these two surfaces under tensile forces. In doing this, the deforming surface is moved inwards in radial direction, while the can's wall is always in contact to the propping surface that engages the radial inner side. It has turned out that the gap region between the two surfaces, which engage both sides of the can's wall, have to be precisely adapted to the wall thickness which is variable in this region, and that the tensile forces in the can's wall have to be continuously chosen in such a way that necking does not result in a bulb. In the case of a bulb, the forces acting through the two surfaces onto the can's wall would become locally very high which entrains the risk of damaging. It has turned out that keeping the appropriate conditions when necking by cooperating deforming and propping surfaces is very difficult.

Apart from a restricted neck portion, narrowing is also desired at the transition to the bottom surface of current can bodies. Since mostly the bottom has already been inserted when forming the neck portion, narrowing the bottom region is suitably done previously which, however, is difficult with a can shell having no upper or lower closure.

For esthetic reasons and to mark its contents, a decoration is applied at the outside of the shell surface. In order to be able to do without expensively and inflexibly printing the can body, printed films are applied onto the can body. According to EP 0 525 729, a decorating film is directly wound in peripheral direction onto the can body, and is connected to form a closed film envelope on the can body. Separating a piece of film is very difficult with thin films. To interconnect the film ends by a seal connection, a seal surface is pressed against the can body which is, however, not quite convenient with thin-walled cans due to their small stability. With cans whose outer surfaces are restricted at the lower, and particularly at the upper can end and which deviate from a cylindrical surface, forming a non-wavy seal connection over the whole can height is not possible.

Solutions are known from documents U.S. Pat. No. 4,199,851, DE 197 16 079 and EP 1 153 837 A1 where a shrinkable flat plastic material is wound around a coil mandrel to form a closed envelope, is shifted in axial direction as an all-around label onto a bottle or a can, and is then shrunk-fixed. Shifting the all-around label over a bottle or a can without jamming involves various problems, particularly with thin films. With the thin decorating films mentioned in EP 1 153 837 A1, having a thickness of less than 25 μm, preferably between 9 μm and 21 μm, the risk of deforming or damaging is very high when shifting the closed film envelops from the coil mandrel onto the can body. The printable commercial plastic film Label-Lyte ROSO LR 400 of the Mobil Oil Corporation comprises a thin seal layer on both sides and is available with a thickness of 20 μm and of 50 μm. When sealing the overlapping zone the sealing layer which engages the coil mandrel is also heated and pressed against the coil mandrel. The film has now different sliding properties in the region of the seal strip. Further problems may occur through friction dependent electrostatic loads and the involved forces which act onto the film. Transferring a cylindrical closed film from a coil mandrel to a can body is problematic even if the diameter of the coil mandrel is a little bit larger than the diameter of the can body. A clear difference in size is not desirable, because in this case the ability of shrinking of the film has to be larger, and there is the risk that undulations form under fix-shrinking. In addition, for raising the ability of shrinking a film of a greater thickness had to be used which is not desirable. A further problem consists in that thin films can be separated only at large expenses. Due to the difficulty of separating alone, solutions are not desired where film pieces are wound around a coil mandrel or around a can body.

The known approaches for producing cans use expensive installations, and their operation is dependent upon a specialized personnel. Therefore, the cans cannot be produced at the filling factories. Thus, much transport expenses will occur to transport empty cans from the can producer to the filling factories.

SUMMARY

It is an object of the present invention to find a solution by which esthetically attractive cans may be produced in a cost-effective manner using a simple installation.

This object is achieved by the characteristics of claim 1 and claim 18 or claim 21. The dependent claims describe preferred or alternative embodiments. The term can body should mean all containers, particularly also collapsible tubes, and container-shaped intermediate products. When solving the task, a process for forming a neck portion at an open can end according to claim 17, a process for fixing a can closure comprising a valve according to claim 16, a can body including a valve seat according to claim 22, and a can closure including a valve according to claim 23 have been found, the subject matters of which are new and inventive even independently from the can production.

When solving the task, one recognized in a first inventive step that the longitudinal seam can be formed particularly efficiently and with an extremely high quality, if it can be produced continuously over a large extension of length. A longitudinal seam can be produced continuously over a large extension of length, if the longitudinal seam is welded on directly joining can shell surfaces closed in peripheral direction or with a tube production. After welding, the can shells, which join each other, can subsequently be separated from one another, while in some cases separating has to be effected at the seam. The closed shell surfaces are separated from a tube as tube sections.

A tube is preferably produced from a metal strip, for example in accordance with DE 198 34 400. A forming device forms the metal strip continuously in such a way that the two lateral edges contact each other, and a welding device welds these lateral edges together. Forming the strip into a tubular shape is preferably effected by plying the strip in transverse direction about a tube axis parallel to the longitudinal axis of the strip. The cross-sectional shape may be chosen for forming in such a manner that welding can be done efficiently. The term tube shall mean any closed shell surface extending around an axis. In a preferred embodiment, a flat pressed tube is produced, wherein, preferably prior to forming, two incisions in the strip are made perpendicularly to the strip axis of the flat strip. These incisions are arranged in such a manner that, after a forming step for the strip, they extend in the bent regions of the flat pressed endless can shell. In this way, cutting for separating the desired can shell sections can be limited to the flat pressed region between the bent regions.

The metal strip is unwound from a coil and, therefore, may have a very great length. If the coil change is realized in such a way that the leading end of a new coil joins immediately the trailing end of the old coil, one can speak of a continuous tube production. Therein, the longitudinal seam may be substantially formed as an uninterrupted seam of a high quality.

When metal plates are processed, first, sections are severed having the size of a can shell. From these sections one may form closed can shells. In a preferred embodiment, these can shells are pressed flat and have two bent regions. The longitudinal seam is welded at the directly joining sections. Sections of the same cross-sectional shape, which join each other directly, form a tube.

The welding device remains preferably stationary, and the metal sheet formed into a tube-shape is moved past the welding device. For forming the seam, various welding techniques may be used. However, preferably the seam is produced by laser welding. The edges of the metal strip interconnected by welding join in some cases in an overlapping manner, but preferably as a butt-joint or jump joint. With a butt-joint, steps or differences in thickness can even be avoided in the region of the seam so that a substantially constant wall thickness of the tube in peripheral direction is ensured. This is particularly advantageous for forming a restricted neck portion. From the continuously forming tube, sections with the length of the desired can height are severed.

In a second inventive step, it has been recognized that preferably a novel and inventive separating process may be used for a continuous tube for severing tube sections, which are further processed as can shells. The known separating processes are sawing processes. Therein, a severing device, such as a cutting-off wheel or a sawing band, is carried with the tube during the sawing procedure. Having severed a tube section, the severing device is reset. Due to the short tube sections, required in the can production, the known severing devices are insufficient, because they are not able to severe and reset sufficiently quickly. A further disadvantage of the known severing devices consists in that there is the risk of a deformation and, thus, of jamming particularly with thin-walled tubes. Moreover, with the known severing processes sawdust is created which would make necessary additional cleaning steps and/or would cause some problems in the further can production steps.

If the tube is pressed flat for the novel and inventive severing of tube sections, a cutting process may advantageously be used with thin sheets. In doing this, for example, the flat-pressed tube is guided on a base which may cooperate with a cutting edge. As soon as a desired length of a tube section is advanced, the cutting edge is moved together with the tube, and is moved, while cutting through the inter engaging wall regions of the tube. With cutting, no sawdust is produced, and the cutting procedure is extremely fast so that the cutting edge, after a return motion away from the base surface, can be sufficiently quickly moved back in longitudinal direction of the tube, even with short tube sections, to carry out the next cutting procedure in time. With a cutting edge fixedly placed in the direction of the tube axis, it has to be ensured that the tube is able to bend in a bending region due to fixing at the cutting edge so that the retained advance motion is absorbed as a bending elongation in the bending region. After cutting, bending is compensated by a somewhat higher advance speed of the tube end at the severing device. It will be understood that cutting processes are also possible, in which the tube is not pressed flat.

If a tube has been already provided with a decorative film when severing the tube sections, the decorative film can be cut directly in conjunction with the stability providing portion of the can shell. In this way, one can do without cutting thin film pieces separately. It would be possible to apply the decorative film already prior to forming the tube onto the metal sheet, in which case, however, the film would be affected in the region of the longitudinal seam when welding this longitudinal seam. In some cases, the film is only applied to the welded tube, This is preferably done by supplying a film strip in the direction of the tube axis, the film strip being wrapped in peripheral direction around the tube so that the two edges of the film either abut to each other or overlap a bit one another. The adherence of the decorative film to the tube is achieved, for example, by a sealing procedure. Applying a film web, to be unwound in longitudinal direction of the tube, to the outside of the tube being formed is substantially simpler than wrapping film pieces around tube sections. But directly joining can shell surfaces, being closed in peripheral direction, can be covered, like a tube, at the outside with a film.

If the starting material, i.e. either metal plates or the strip, is provided with a decorative film and/or with an inner film, the film can be cut directly in conjunction with the stability providing portion of the can shell when cutting the open or closed shell sections. In this way, one can do without cutting thin film pieces separately.

If the decorative film is applied to the metal sheet already prior to forming the longitudinal seam, affecting the decorative film during welding of the longitudinal seam can be prevented by additional treatment steps. For example, the decorative film may be arranged on the flat material in such a manner that one of its marginal region does not reach up to the side face, while its other marginal region protrudes beyond the respective side face. The protruding film portion will not be fixedly sealed to the flat material in a marginal region of the same so that this free film margin may be plied away from the region of the welding seam before the welding seam is formed. After the welding procedure, the free film margin can be put over the welding seam and can be sealed. In this way, the longitudinal seam is completely covered. It has turned out, that for welding the longitudinal seam laser can be used which form only a very narrow seam. In the region of a narrow seam, the decorative film may be removed by a further laser. In this way, one can do without having a film-free marginal region, and the decorative film may be applied to the metal sheet over the entire width.

After severing tube sections, be they with or without a decorative film, these tube sections are opened by a shell forming device in such a way that can shells are provided into which a bottom can be inserted. Opening can ensure a desired cross-sectional shape, and if the entire circumference is somewhat increased, even a desired reduction of wall thickness can be achieved. This reduction of wall thickness may be used for precisely approaching a desired wall thickness. When pushing open, it has been recognized that it is not only the desired cross-sectional shape that can be formed, but that a cross-sectional restriction from an enlarged to a smaller or original cross-section may be created when enlarging the cross-section at the can end, towards which an enlarging tool is moved. Such a small cross-sectional restriction would be particularly adapted for forming advantageous connections between the can shell and a can bottom. The cross-sectional restriction would suitably be formed with a radius of curvature which corresponds to shape that is current in aerosol cans at the transition from the can wall to the can bottom.

With a can shell having a small cross-sectional restriction, as is provided for at one can end in aerosol cans, a can bottom may be put to engage the restricted marginal region, and may be attached in a sealing manner to the can shell by circumferential welding. If the can bottom is put to engage the cross-sectional restriction from the interior and is welded to it, with a can that stands on its support surface, it is merely the cross-sectional restriction of the can wall towards the support surface that is visible. The inserted can bottom cannot be seen. The can, in the region of the can bottom, has the appearance of an aluminum mono-block can.

Because no treatment, which hardens the material, is carried out when producing the can shell, a necking process known in the prior art, such as upset necking or spin-flow-necking, can be effected at the upper end of the can shell. This necking can be carried out up to forming the valve seat. Preferably, however, necking is effected only to such an extent that a closure member together with the valve seat can tightly be arranged at the upper restricted end. In some cases, the connection is formed as a folded seam connection, but preferably as a welded connection, particularly as a laser welded connection. Inserting the closure member including the valve seat ensures the production of cans having an extremely precise valve seat by a simple production process.

Since for tightly pressing the closure member to the can shell a shoulder-shaped restriction is required at the face of the can shell as well as a correspondingly shaped marginal region of the closure member, an annular buckle radial to the exterior may be formed at at least one face, in some cases at both faces. In this way a restricted cross-section is obtained towards the respective face. At one face, the can bottom, and at the other face an upper closure member may be fixedly welded to the respective restriction. Preferably, it is the bottom which is welded first. Prior to or, in some cases, after fixedly welding the upper closure member, the can shell may be formed, for example by enlarging the can's cross-section at least up to the diameter of the at least one buckle.

Prior to fixedly welding the upper closure member, forming tools, such as rolls, may be inserted into the interior of the can for enlarging the can shell. In some cases, even a fluid under pressure is introduced into the interior of a can for enlarging the can cross-section, and the can shell is pressed into an inner mold, as is known from Patent nos. EP 853 513 B1, EP 853 514 B1 and EP 853 515 B1. Other processes known from the prior art for enlarging and forming a can shell may also be used.

Within the frame of the present invention, a process for fixing a valve to a can body has been found which is novel and inventive even independent from the production process for the can shell. For fixing a valve to an aerosol can, a valve seat is provided on the can body. A connection bowl including the valve is crimped on the valve seat. If the valve seat is formed by necking and forming the can shell, breathers are formed at the valve seat which may lead to undesirable micro-leakages after crimping the connection bowl. Even with a valve seat, which is formed separated from the can shell on a closure member, breathers may occur. And even if no breathers appear, crimping the connection bowl to the valve seat is an expensive treatment step. In addition, a valve seat of a standard diameter is used for aerosol cans of a differently large diameter which has as a consequence with small cans, that one cannot fall below a minimum can diameter.

In the frame of an inventive step, one recognized that the construction, which comprises a valve seat and a valve as well as a connection bowl, is due to the fact that the valves are set onto the aerosol cans at the filler to enable filling prior to setting the valves. However, it has turned out that many products are filled into a can through the valve. Filling through an annular zone between the valve seat and the connection bowl and subsequent crimping is not necessary with many products. Therefore, fixing the valve may be done prior to filling.

With aerosol cans which are filled through the valve, the upper end region of the can shell may be connected to an upper closure member including the valve. The closure member corresponds substantially to a connection bowl without an encompassing zone for the valve seat. The valve is located at the center of the closure element, and the closure element is preferably merely dome-shaped. With a welding step, the closure member with the valve is fixed to the can shell by laser welding. A circumferential, closed seam ensures then a tight and solid connection at small expenses, if the free end of the can shell is somewhat restricted so that the engaging marginal region of the closure member may be tightly pressed on and may be secured to the can shell by a laser welding seam. By arranging a sealing material to the inner side of the can shell in the region of the welding seam, one may ensure that a complete inner coating is guaranteed after welding the can body.

There is a multiplicity of advantages of this inventive approach. One can do without forming or fixing a valve seat on the can body, and the expensive crimping step is omitted. Correspondingly, the filler can do without an installation for fixedly crimping connection bowls. However, it is also possible to produce aerosol cans, the diameter of which is smaller than the diameter of a standard valve seat.

A laser welding connection between the can shell and the closure member can be formed in a simple manner, if the can shell has a constant thickness at the upper end. This is the case with can bodies which are either produced by deep-drawing or where the can shell is closed with a butting longitudinal welding seam.

Within the scope of the present invention, a necking process has been found which is novel and inventive even independently from the production process for the can shell. Thus, the process may be used for all can bodies where a restriction may be achieved at an open can end. In this process, the can body to be necked is held in two regions. In the first region, the can body is firmly held by a first holder so that it can be rotated about its longitudinal axis by the first holder. The number of revolutions is about in the range of 800 to 1500 rpm. The second region is at the can end to be necked. There, the can body is held by a second holder that rotates with it. The second holder comprises a bearing portion displaceable in longitudinal direction relative to the can body. The bearing portion comprises an annular deflection edge at that end which is directed towards the can's interior. At least one forming surface is arranged to join the deflection edge in axial direction and to be pressed in radial direction against the inside. The forming surface is preferably formed as a tread surface of a rotatably supported roll. A free space is provided radial within the forming surface in the can's interior so that nothing obstructs forming the can wall towards the interior.

The at least one forming surface, preferably the outer surface of a roll, is pressed against the can wall close to the deflector edge, while the can body rotates. In this way, a groove is formed in the can wall. This groove, due to its extension in radial direction, confers some stability to the can body. Any deformation, which deviates from a rotationally symmetrical shape, is prevented by the groove. If now the bearing portion with the deflector edge is moved away from the groove relative to the can body, the groove may be deepened radial inwards by a motion of the forming surface. At the same time, the can body is moved in longitudinal direction of the can to obtain the desired neck shape. The motion of the forming surface in radial inward direction creates tensile forces in the can wall. It has now turned out that the cooperation of the annular deflector edge with the forming surface, and, thus, the omission of a propping surface situated in the can's interior, facilitates necking and prevents the creation of places of punctually high loads. For obtaining the desired forming properties of the can material, the cooperation of the deflector edge with the at least one forming surface is sufficient. The can wall, moved around the deflector edge, assumes a plastic state in the region of the forming surface pushed forward towards the interior. It is advantageous, if at least two, particularly three or more, forming surfaces are arranged at equal angles around the can's periphery. As compared with the known spin-flow-necking devices, a device for carrying out the novel necking method is substantially simpler in construction, because a propping roll or a propping surface may be omitted which is displaceable and located out of the center in the can's interior.

In some cases, a base covering is applied in such a way that it covers the connection of the can shell with the can bottom. Preferably, the base covering consists of a flat plastic material. It will be understood that a flat material having at least one metal layer, particularly of aluminum or steel, or even with a layer of paper board may also be used. The stability conferring layer may, in some cases, be coated with a plastic material. The flat materials used should ensure a robust base covering which will not be damaged in the conveyor devices of filling installations, and which remains as stable as possible even when standing on a wet support. The base covering may be provided with a sealing layer so that it may fixedly sealed at the bottom. Instead of a sealing connection, in some cases a locking connection or a welded connection, particularly with at least three laser welding points, can be formed to fix the base covering. If a magnetizable base covering is used, it may enable a conveyance by a magnet conveyor even with can bodies of non-magnetic material.

The production of a can body having a decorative film is particularly advantageous, if a film is used which is printed optionally on its external side or front side, but preferably on the side facing the can body or back-side. Using a transparent film printed on the back-side, the printed layer of the film is protected so that no affection of the decoration due to friction can occur. A transparent film printed on the back-side may be provided with a sealing layer over the printing layer after printing which ensures a firm sealing connection between the film and the can body as well as in the overlapping area between the film margins even through the printed layer.

In some cases, it is advantageous if the printed layer at the film's back-side has substantially the function of a primary coat, while the remaining decoration is printed onto the front side of the film. When it is the question of a primary coat, this may either be a monotonous primary color or also part of the decoration, for example the surface of a color or image design. The film web preprinted on the back-side in a first printing office is printed on the front side in a further printing step. This further printing step can optionally be effected at the can producers or in a second printing office to print a specific decoration/information. This means, for example, that in the second printing step, in addition to a primary decoration, an inscriptions are printed which are different each for the respective market. For printing the front side, any printing process known in the art may be used, optionally including some surface treatment after printing.

BRIEF DESCRIPTION OF THE DRAWINGS

The drawings explain the approach according to the invention with reference to an embodiment. It is shown in FIG. 1 a schematic representation of an installation for producing can bodies, FIG. 2*a* a cross-section of a metal strip having a plastic film applied and a seam covering tape, FIG. 2*b* a cross-section of a tube, which has been formed from the metal strip according to FIG. 2*a* by bending it about the longitudinal axis, FIG. 2*c* a cross-section of a tube according to FIG. 2*b* after pressing it flat, FIG. 2*d* a detail of the flat pressed tube according to FIG. 2*c*, FIG. 2*e* a detail according to FIG. d after fixedly sealing the seam covering tape, FIG. 3*a* a cross-section of a flat pressed tube including a plastic film wrapped around the tube, FIG. 3*b* a cross-section of a flat pressed tube onto which press rolls press a plastic film wrapped around, FIG. 3*c* a plan view of the arrangement according to FIG. 3*b*, FIG. 4 a cross-sectional representation of a cylindrical can wall and an enlarging cylinder situated therein in two positions, FIG. 5 a schematic plan view of a treating station in which cans on a turn-table are connected to a closure member, FIG. 6*a* a treating station according to FIG. 5 comprising optical light guide cables for laser welding, FIG. 6*b* a lateral view of a treating station according to FIG. 5 comprising optical light guide cables for laser welding, FIG. 7 a cross-section of a holding device for a treating station according to FIG. 5 and a can body where a bottom is inserted, FIG. 8 a cross-section of a holding device for a treating station according to FIG. 5 and a can body where the upper closure member is inserted, FIG. 9*a* a cross-section of a necking device comprising two situations at the beginning of a necking procedure, FIG. 9*b* a cross-section of a necking device comprising two situations during the necking procedure, FIG. 9*c* a cross-section of a necking device comprising two situations at the end of the necking procedure, FIG. 9*d* a cross-section of three forming rolls, FIG. 10*a* a cross-section of a can body of an aerosol can having the bottom inserted and a valve seat put on top, FIG. 10*b* a lateral view of a can body having a particular appearance, FIG. 11*a* a cross-section of a collapsible tube having a threaded portion inserted, FIG. 11*b* a cross-section of a collapsible tube having a threaded portion put on top, FIG. 12 a cross-section of the upper end region of an aerosol can including a novel valve adapter, FIG. 13 a cross-section of the upper end region of an aerosol can and two different valve seats, and FIG. 14 a cross-section of the lower end region of a can body including a base covering, FIG. 15*a* a vertical cross-section of a can shell having buckles at both front sides, FIG. 15*b* a vertical cross-section of a can body having buckles on the can shell, and fixedly welded closure members, FIG. 16 a vertical cross-section of an aerosol can including an upper closure member and a valve, FIG. 17 a part of a vertical cross-section of an aerosol can including an upper closure member and a valve, FIG. 18*a* a schematic plan view of a severing device which cuts strips from metal plates, FIG. 18*b* a schematic lateral view of a device for applying films on both sides of the strips, FIG. 18*c* a schematic plan view of a portion of installation which cuts section from strips and forms them into flat pressed can shells, FIG. 18*d* two schematic cross-sections of treating steps for forming sections into the shape of flat pressed can shells FIG. 19 a schematic lateral view of an installation which covers a strip-like flat material with films on both sides, and which converts the strip material continuously into the shape of a flat pressed can shell, FIG. 19*a* a plan view of the flat material after providing incisions, FIG. 19*b* a schematic cross-section in the region of forming elements for forming the strip material into the shape of the flat pressed can shell, FIG. 20 a cross-section of the shape of the flat pressed can shell, FIG. 21 a schematic cross-sectional view of the step of applying a covering tape, FIG. 22 a schematic cross-section of a device for laser welding the longitudinal can seam, FIG. 23 a detail of FIG. 5 at a larger scale, FIG. 24 a schematic lateral view of an installation part for laser welding the longitudinal seam, for pressing on the covering tape, and for cutting and conditioning closed can shell sections, FIG. 25 a cross-section of a device for pressing on the covering tape.

DETAILED DESCRIPTION

Figure 1:
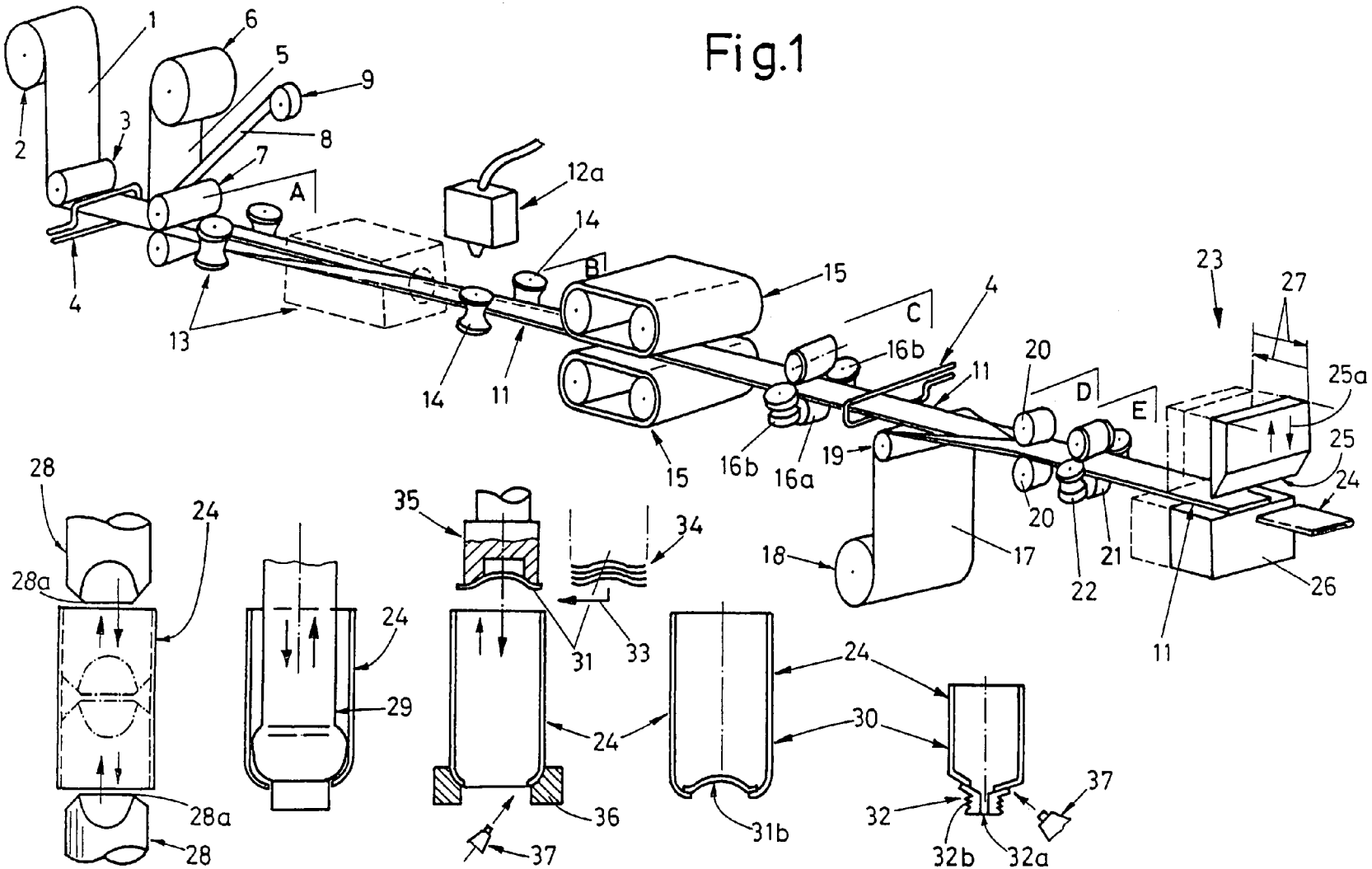

FIG. 1 shows an installation for producing can bodies in which a metal strip 1 is supplied from a metal strip supply coil 2 over a deflection device, for example a first deflection roll 3 in the direction of a treatment axis to various treating stations for producing a tube formed by forming and welding. Optionally, the metal strip is preheated by an induction heater 4. Next to the induction heater 4, a first film strip 5 is applied, if necessary, to the metal strip 1 in the direction of the treatment axis from a first film supply coil 6 over a deflection device, for example a second deflection roll 7. The second deflection roll 7 may press the first film strip 5 to the preheated metal strip 1 so that a sealing layer of the first film strip 5 connects at the given temperature the film strip 5 to the metal strip 1. The first film strip 5 should form an inner barrier or inner protective layer 5' on the tube being formed. For forming a closed tube, a welding connection between both lateral edges of the metal strip 1 is necessary. Since the film strip 5 does not stand the temperature generated in the region of the welding seam, the film strip 5 will optionally not extend up to the edges of the metal strip 1 in lateral direction. However, to be able to form, nevertheless, a closed inner barrier, a seam covering tape 8 is applied to the first film strip 5. To this end, the seam covering tape 8 runs from a covering tape supply coil 9 over a deflection device, for example the second deflection roll 7, in the direction of the treatment axis onto the first film strip 5. A sealing layer of the seam covering tape 8 is facing upwards. The seam covering tape 8 should adhere merely temporarily to the first film strip 5.

Figure 2A:
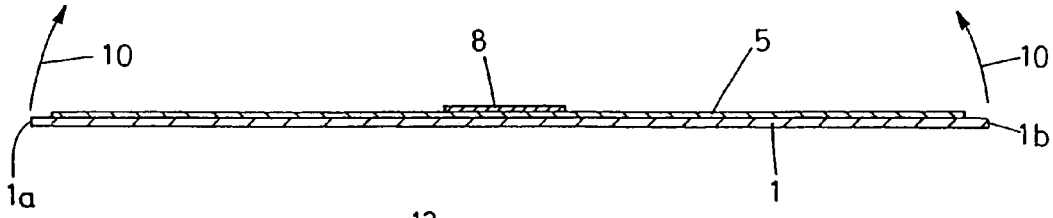

FIG. 2*a* shows the metal strip 1 with the film strip 5 connected thereto, and the applied seam covering tape 8 in the cross-sectional region A according to FIG. 1. Arrows 10 indicate the subsequent forming procedure. By bending, according to FIG. 2*a*, the lateral edges of the metal strip 1 around the longitudinal axis and approaching them to one another, a tube 11 is obtained. To connect the interengaging lateral edges 1*a*, 1*b* of the metal strip 1, a welding seam 11*a* is formed in a welding step including a welding procedure 12. A region 11*b* left free of the film should be covered after welding by seam covering tape 8.

Figure 2B:
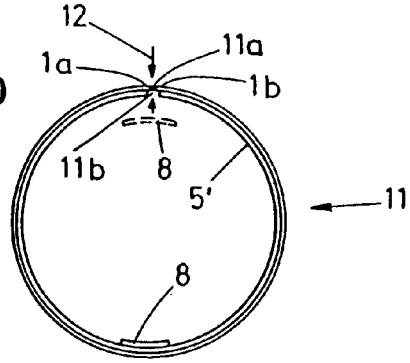

According to FIG. 1 a forming device 13 is provided for the forming procedure, wherein the metal strip 1 is formed into the tube 11, preferably using rolls. To carry out the welding procedure 12, the lateral edges are pressed together by holding rolls 14 so as to be free of a gap, while a welding device 12*a* carries out the welding procedure 12. In this way, the welding seam 11*a* is obtained in the region 11*b* that is free of film. Preferably, a laser welding device is used, but optionally a conventional welding device is used as is known from the traditional production of three-part can bodies. In the section B, the tube 11 has about the shape according to FIG. 2*b*. In the production of cans which do not need an inner barrier or an inner protective layer 5', one can omit the supply of a film strip 5 and of a seam covering tape 8.

Figure 2C:
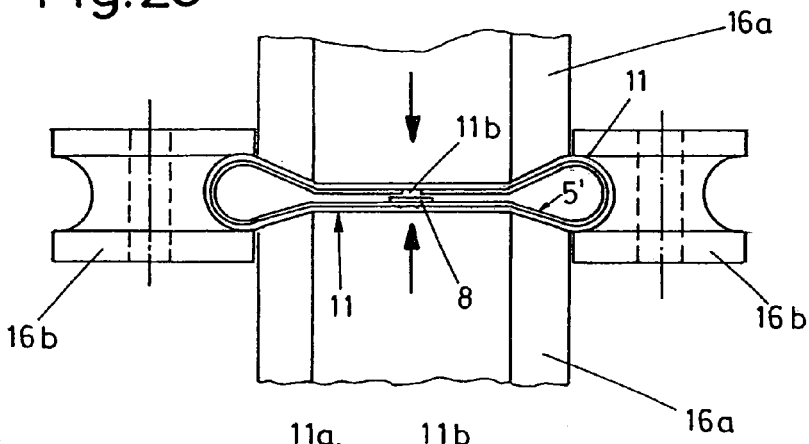

For the continuous production of the tube 11, as provided, the formed metal strip 1 has to be conveyed continuously. To this end, for example, two conveying caterpillars 15, moving in opposite senses, are provided which press against the tube 11 from opposite sides and entrain the tube 11 by friction. Since the seam covering tape 8 must reach the region 11*b* free of film, the tube 11 is compressed at least in the region of the seam covering tape 8. This compression is optionally achieved in part by the conveying caterpillars 15. When compressing, to obtain a desired shape in section C, at least a pair of flat pressing rolls 16*a* is provided according to FIG. 2*c*. To obtain a defined shape of the two lateral folding regions 11*c*, it may optionally be convenient, to associate lateral forming rolls 16*b* to the two flat pressing rolls 16*a*. Since the rolls 16*a* and 16*b* press in pairs each in opposite directions against the tube 11, the tube 11 can be formed in a desired cross-sectional shape.

Figure 2D:
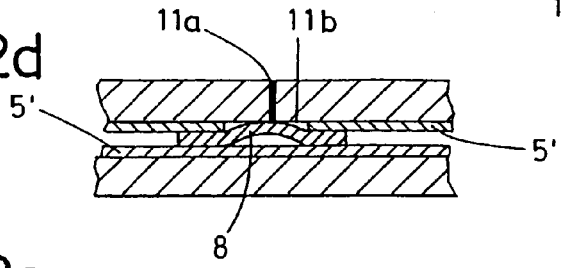
Figure 2E:
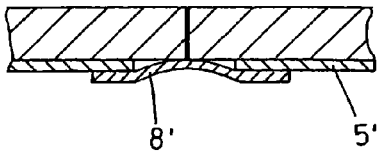

FIG. 2*d* shows how the seam covering tape 8 is pressed against the inner protective layer 5' in the region 11*b* free of film by compressing the tube 11. When the seam covering tape 8 comprises a sealing layer on the side which engages the inner protective layer 5' and the region 11*b* free of film, a sealing connection may be formed to the inner protective layer 5' and, optionally, the region 11*b* free of film under the effect of heat. In this way, a continuous protective barrier is formed in peripheral direction of the tube. The heat necessary for sealing may be supplied through the flat pressing rolls 16*a* or by an induction heater 4 located in the region of the two flat pressing rolls 16*a*.

Heating the tube 11 and its metal layer 1' by the induction heater 4 may be used, in addition, for firmly applying an outer film layer 17'. To this end, if desired, a second film strip 17 is applied from a second film supply coil 18 over a deflection device, for example a third deflection roll 19, in the direction of the treatment axis to the outside of the tube 11 subsequently to the induction heater 4. An engaging device, not shown, is used which bends the lateral margins of the second film strip 17 around the tube 11 in such a way that the margins are interconnected in an overlapping area 17*a*.

Figure 3A:
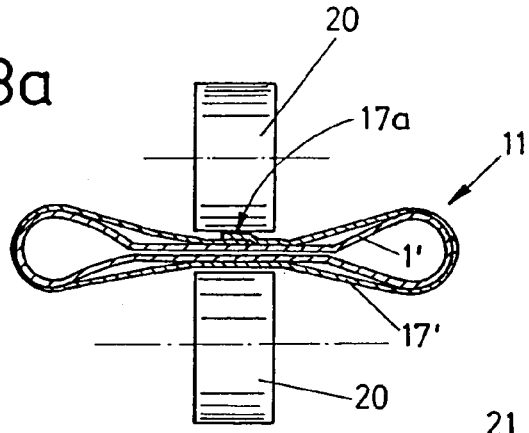
Figure 3B:
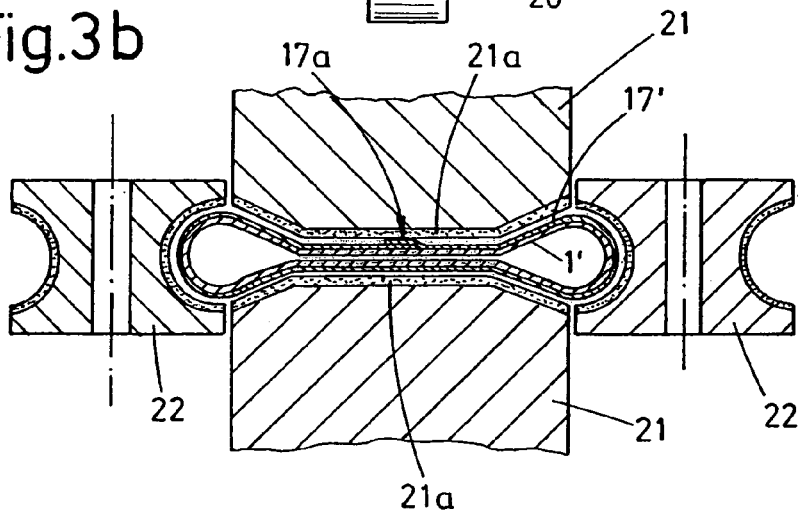

FIG. 3*a* shows the section D comprising two press rolls 20 at both sides of the flat pressed tube region. The press rolls press the film margins in the overlapping area 17*a* against each other. If now the second film strip 17 comprises a sealing layer at the side facing the tube 11, a sealing connection may be achieved in the overlapping area 17*a*. In FIGS. 3*a* and 3*b*, the inner protective layer 5' is not shown, but only the metal layer 1'. To ensure a wrinkle-free engagement of the outer film layer 17' to the metal layer 1', the outer film layer 17' is connected in the overlapping area 17*a* in such a manner that the circumference of the outer film layer 17' is somewhat smaller than the circumference of the tube 11 and the metal layer 1'. Due to the flat pressed shape of the tube 11, this is easily achieved with the open marginal regions.

Figure 3C:
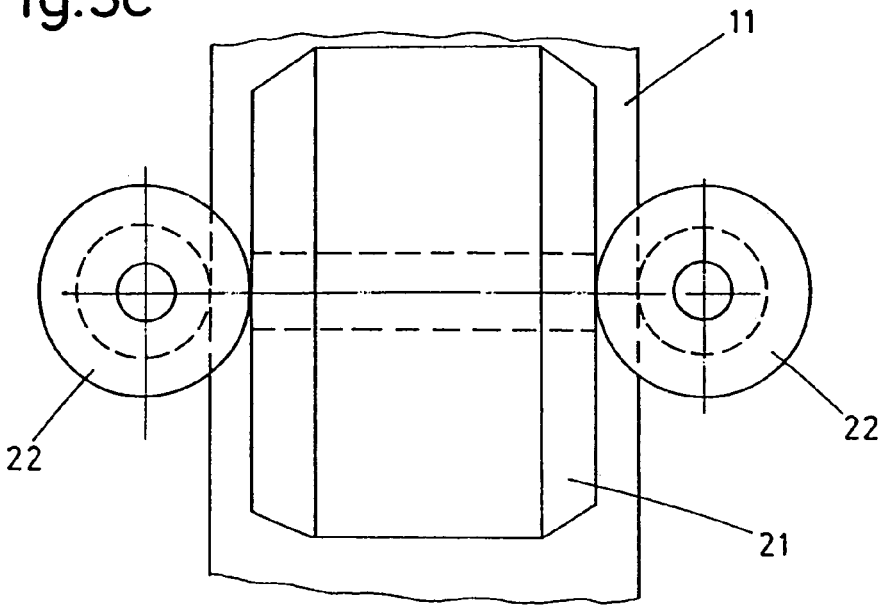

In section E, a compression device according to FIGS. 3*b* and 3*c* comprising at least two first press rolls 21 and optionally two second press rolls 22 are provided. The two first press rolls 21 are situated at both sides of the flat pressed tube region and press the outer film layer 17' tightly against the metal layer 1'. The two second press rolls 21 are situated at both sides of the curved tube region. To ensure a wrinkle-free engagement, the press rolls 21, 22 are preferably provided with slightly elastic coatings 21*a* and 22*a*. It will be understood that the outer film layer 17' may also be omitted. The installation for producing can bodies may be used for can bodies either with or without a film layer. It would also be possible to apply a decorative film according to a known process onto a can body produced in accordance with the novel process. However, continuously applying a film strip onto a produced tube is simpler.

To sever sections having the length of the desired can height from the tube 11, a severing device 23 is provided. The severing device 23 should carry out, if possible, a chip free severing step. Since after the severing step the tube sections or can shells 24 have not necessarily to present a specific shape, a cutting procedure is preferably carried out with a cutting edge 25 and a supporting base 26 cooperating with the cutting edge 25. Due to the fact that the tube 11 is substantially pressed flat, the necessary stroke for the cutting motion represented by arrows 25*a* is small. The small stroke enables a quick cutting procedure. The cutting edge 25 is optionally moved during cutting with the created tube 11 in the direction of the tube axis, and is reset after having severed a tube section 24 which is illustrated by arrows 27. Since the cutting procedure is very quick, the advance of the tube is small during this short time. Therefore, approaches with a cutting edge 25 being stationarily placed in the direction of the tube axis may also be provided. Then, it only has to be ensured that the tube 11 is able, due to the fixation at the cutting edge 25, to bend in a bending region so that the retained advance is absorbed as a bending elongation in the bending region. After cutting, bending is compensated by a slightly increased advancing speed of the tube end at the severing device 23. If the tube end or the end of the severed can shell 24 is completely rendered flat by the cutting procedure, this is of no importance.

If a film strip 5, 17 and, optionally, a seam covering tape 8 is arranged on the metal strip 1, a tube 11 will form having a metal layer 1' and at least one film layer 5', 17. If a film piece is supplied, according to the prior art, to a can shell, the film piece has to be cut from a film supply coil and has to be placed individually on the can shell 24. Cutting and placing thin films is very difficult. The approach according to the invention with continuously applying the film strip 5 and cutting the film in conjunction with the metal layer 1' leads to substantially simpler film coating. Cutting the metal layer 1' together with the film is simpler, because the total thickness of the metal layer 1' and of at least one film layer 5', 17 is sufficiently large for a simple cutting procedure.

The cut and substantially flat can shells 24 may now be formed to can bodies either immediately subsequently or after an intermediate storage or a transport. Due to the flat state, the volume per can shell 24, needed for storing or transporting, is small.

According to FIG. 1, the flat pressed can shell 24 is pushed open during further treatment by at least one push-open tool 28 of a shell forming device. In the schematically illustrated embodiment, push-open tools 28 having insertion edges 28*a* are inserted into the can shell 24 from both open faces of the can shell 24. Optionally, the desired cross-sectional shape is obtained directly with pushing open. Preferably, however, an enlarging tool 29 is used in a further step which increases the circumference of the can shell 24 and, in particular, forms at one can end, preferably the lower end, a cross-sectional restriction from an enlarged to a smaller cross-section.

Figure 4:
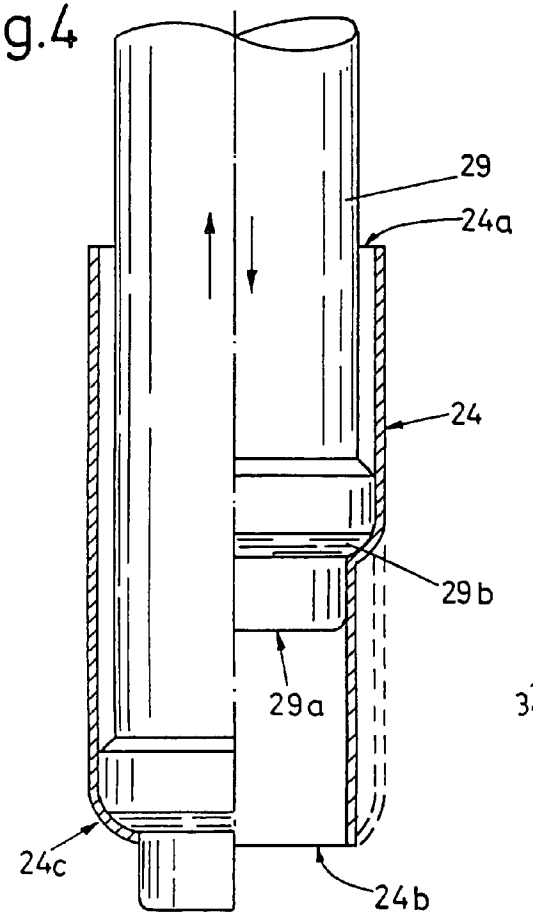

FIG. 4 illustrates the enlarging procedure in two steps. After insertion of an insert front part 29*a*, adapted to the cross-section of the can shell 24, into the can shell 24 from a first face side 24*a*, the enlarging tool 29 having an enlarging portion 29*b* of a larger cross-section is moved through the can shell 24, until it reaches an end position at the second face side 24*b* of the can shell 24. The enlarging portion 29*b* is formed in such a manner that the can shell 24 obtains a desired restriction 24*c* at the second face side 24*b*, particularly with a narrowing radius usual for aerosol cans.

To obtain a can body 30 prepared to be filled, the can shell 24 has to be provided with a closure member at at least one face side 24*a*, 24*b*. For cans, at least one can bottom 31*b* is tightly connected to the can shell 24. In the case of collapsible tubes, a tube closure part 32, having a thread 32*b* around an output opening 32*a*, is fixed. Since more cans are produced than collapsible tubes, and a generic term, as for example container, is confusing, the term can should be understood as far as to comprise also collapsible tubes. According to FIGS. 1 and 5, the closure members 31*b*, 32 are delivered in a delivery step 33 from a supply region 34 to an insertion holder 35. The insertion holder brings the closure members 31*b*, 32 to the desired connection place of the can shell 24. In the case of a welding connection, a welding device 37 produces a welding seam, while rotating the can shell 24 by means of a rotating holder 36. It will be understood that apart from a welding process, particularly laser welding, mechanical connection processes, such as beading or folded-seam processes, may be used. Optionally, the closure member 31*b*, 32 is tightly connected to the can shell 24 by gluing.

Figure 5:
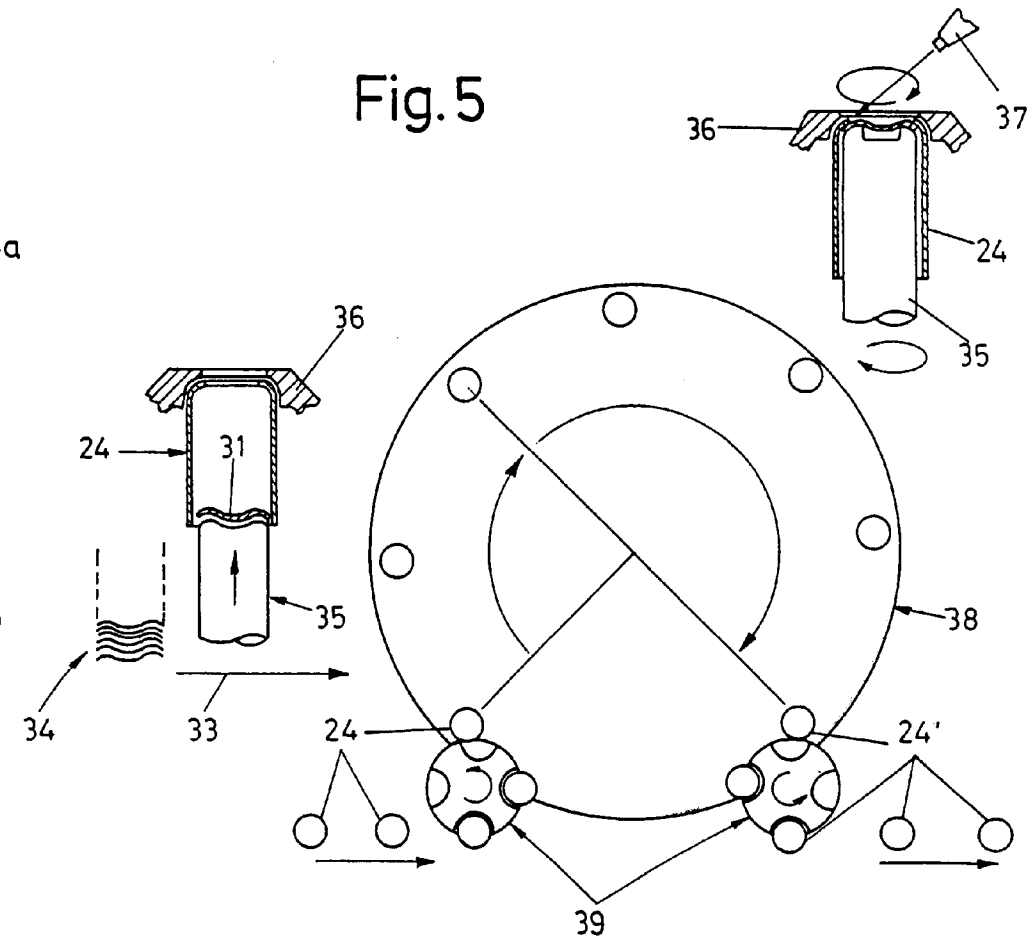

FIG. 5 shows a treating station in the form of a turn-table 38, wherein the can shells 24 reach the turn-table 38 via a transfer table 39, and the can bodies 24' are conveyed away from the turn-table 38 via a further transfer table 39 to a further conveyance.

Figure 6A:
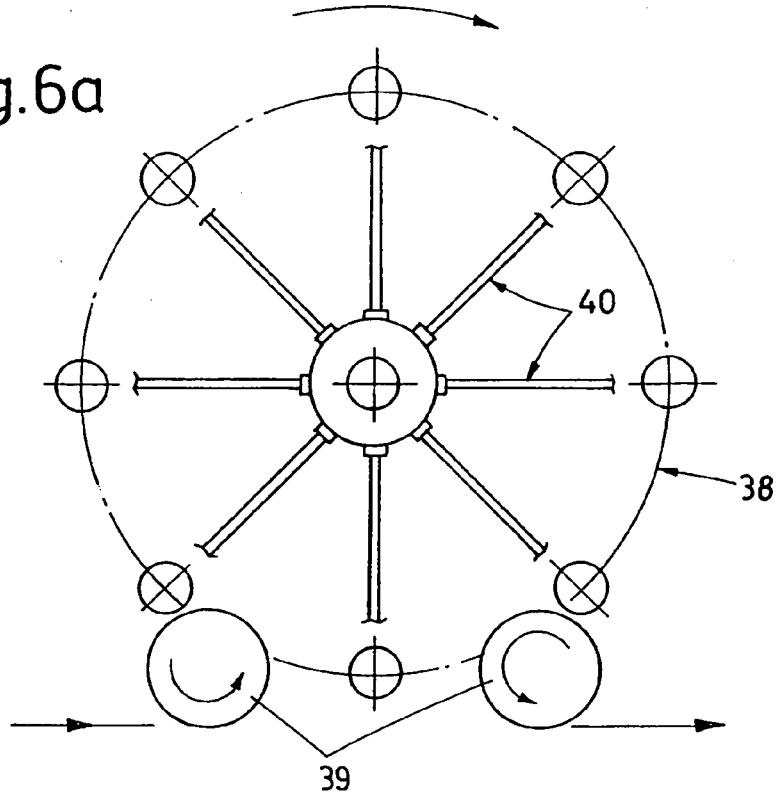
Figure 6B:
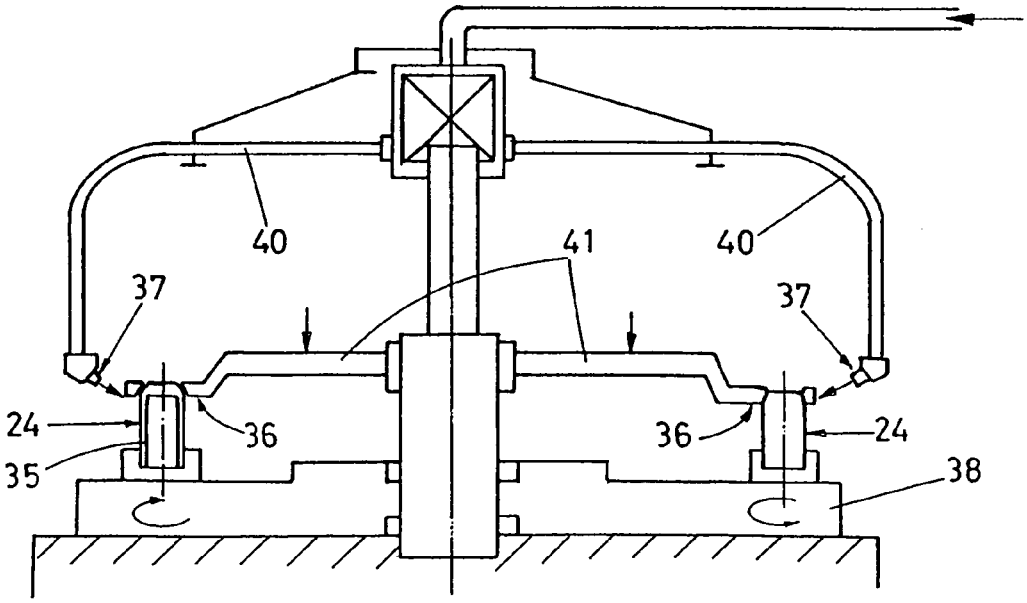

FIGS. 6*a* and 6*b* show the light guides 40 by which a welding beam is directed to the places of treatment of the turn-table 38. The rotating holders 36 are arranged on arms 41 to be pressed against the can shells 24. The insertion holders 35 are preferably coupled to turning drives to be able to produce circumferential welding seams while turning.

Figure 7:
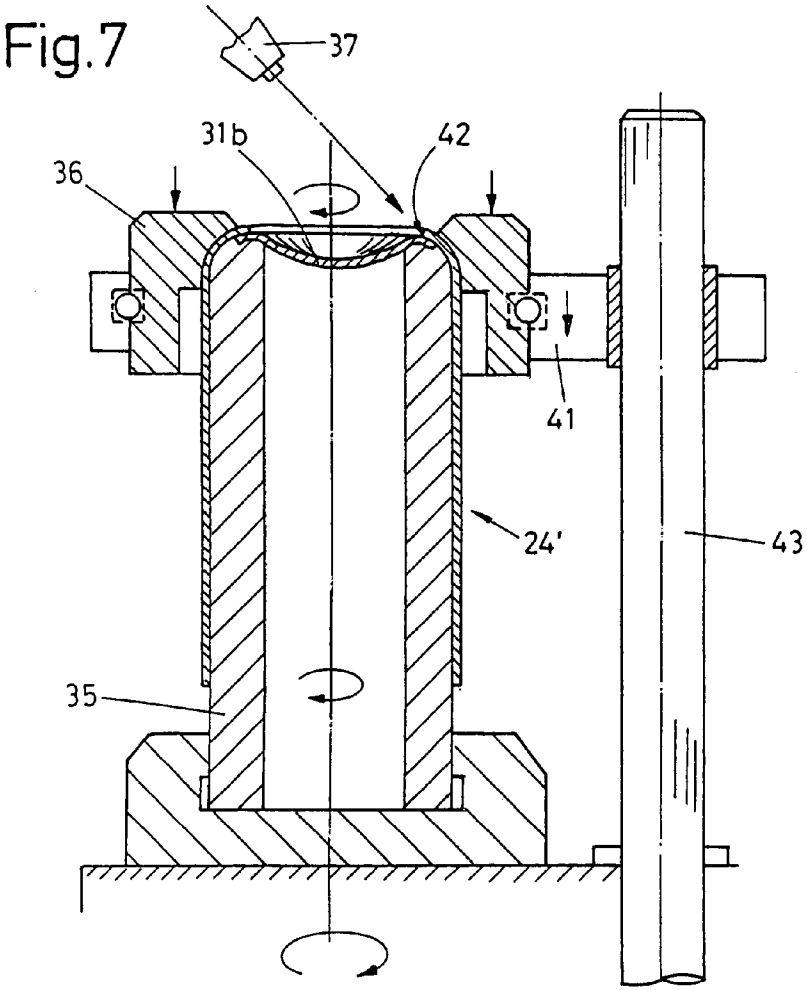

FIG. 7, in the form of a representation of a detail, shows the most important elements of a treatment place for fixing a first closure member 31*b*, 32 to the can shell. When the can bottom 31*b* is pressed from the interior of the can against to restriction 24*c*, a laterally not visible connection seam 42 can be produced by the welding device 37. In order to position the can bottom 31*b* without a large stroke movement, it is optionally pressed against the restriction 24*c* from the exterior. For firmly pressing, the arms 41 and the rotating holders 36 are connected to the insertion holders 35. The connection is effected via a connecting rod assembly 43 with pressing and releasing devices not shown. The outer marginal region of the can bottom 31*b* is adapted to the restriction 24*c* and comprises in the center region a bulging towards the can's interior.

Figure 8:
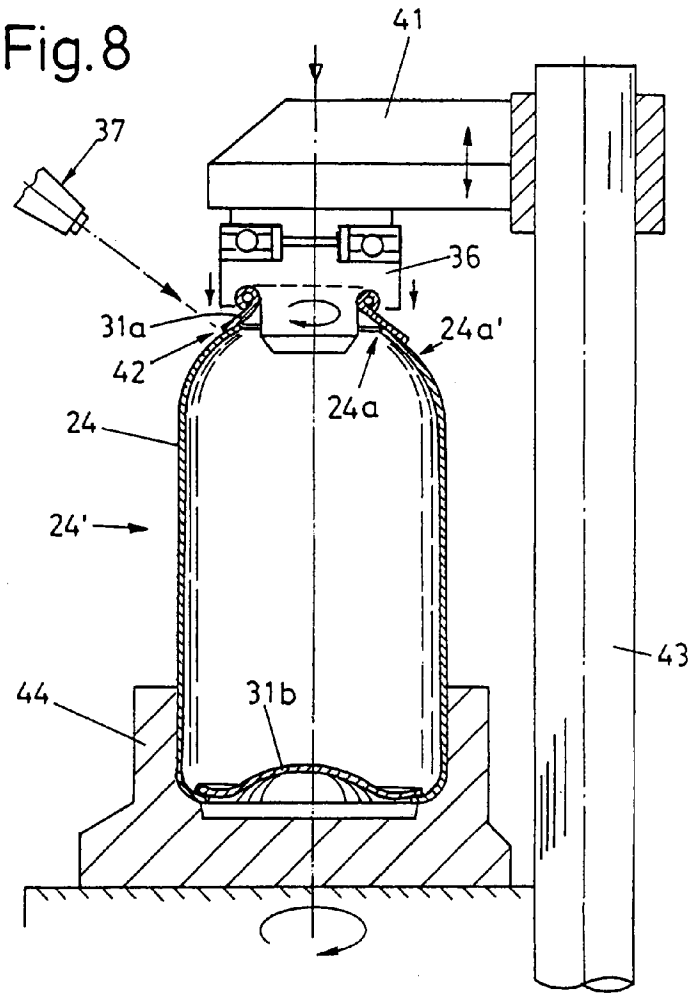

According to FIG. 8, an upper closure member 31*a* having a valve seat (valve adaptor) is fixed to a can body 24' comprising a can shell 24 and an inserted can bottom 31*b*. It will be understood that the upper closure member may comprise another type of opening, for example a threaded neck, instead of the valve seat. The device for fixing the upper closure member corresponds substantially to the device according to FIG. 7, wherein the can body 24' is held by a can holder 44 and is rotated, and the rotating holder 36 is adapted to the upper closure member 31*a*. The first face side 24*a*, averted from the can bottom, is restricted so that a first neck region 24*a*' of decreasing cross-section is formed. The circumference of the upper closure member 31*a* is smaller than the circumference of the cylindrical portion of the can body 24'. Since, in addition, one can do without a folding area for forming a beading or folded-seam connection, the proportion of material of the upper closure member 31*a* is significantly smaller as compared with known approaches. The connection seam 42 ensures a firm and tight connection between the first neck region 24*a*' and the upper closure member 31*a* which, in the outer marginal area, forms a second neck region which is adapted to the first one.

For necking the open face of a can body 24', a known necking process can be carried out, such as upsetting/necking or spin-flow-necking. Preferably, however, as represented in FIGS. 9*a-d*, a process is carried out, which is novel and inventive even independently from the other production steps, wherein a can body 24' to be necked, which extends along a longitudinal axis 24*d* and has circular cross-sections in the region to be necked, is held in two regions. In the first region, the can body 24' is firmly held by a first holder 45 in such a manner that it may be turned about its longitudinal axis 24*d* by the first holder 45. For holding it firmly, an annular clamping element 45*a* is optionally provided which, in particular, may be pneumatically brought into a clamping position and a releasing position. However, a mechanical clamping arrangement, for example comprising three clamping elements 45*a* which are uniformly distributed around the periphery, may also be provided. The second region is at the can end to be necked or at the first face side 24*a*. There, the can body 24' is held by second holder which co-rotates with it and which comprises a supporting part 46 displaceable relative to the can body 24' and to the first holder 45 in longitudinal direction. The displaceable supporting part 46 is inserted into the can body 24' in a peg-shaped fashion and comprises at the end directed towards the can's interior an annular deflection edge 46*a*, the outer diameter of which being adapted to the inner diameter of the first face side 24*a*.

The desired necking is achieved with at least one deforming surface 47*a* which joins the deflection edge 46*a* with a small distance in axial direction and may be pressed inwards in radial direction, while a free space 48 is provided in the can's interior so that nothing obstructs forming the can shell 24 or the can's wall in inward direction. Optionally, a propping peg is provided which projects from the supporting part 46 into the can's interior and whose diameter is adapted to maximum necking so that the necked face, after necking, is supported by this peg. The deforming surface 47*a* is preferably formed by the outer surface of a forming roll 47. An optimum cooperation of the deflection edge 46*a* with the deforming surface 47*a* is important for necking. To this end the radii of curvature R1, R2 of the two curvatures of the deflection edge 46*a* and the deforming surface 47*a* are fitted to each other. According to an analogy to a deep-drawing process, where the can wall is drawn around two annular edges, the radius of curvature R1 corresponds to the holding-down radius and R2 to the drawing radius. The gap s between the deflection edge 46*a* and the deforming surface 47*a* in the direction of the can axis 24*d* is fitted to the thickness of the can's wall and remains substantially constant during necking. The at least one forming roll 47 is, in axial direction, in a substantially stationary position relative to the support part 46. The at least one forming roll 47 is moved together with the support part 46 in axial direction relative the first holder 45.

Figures 9A, 9B, 9C:
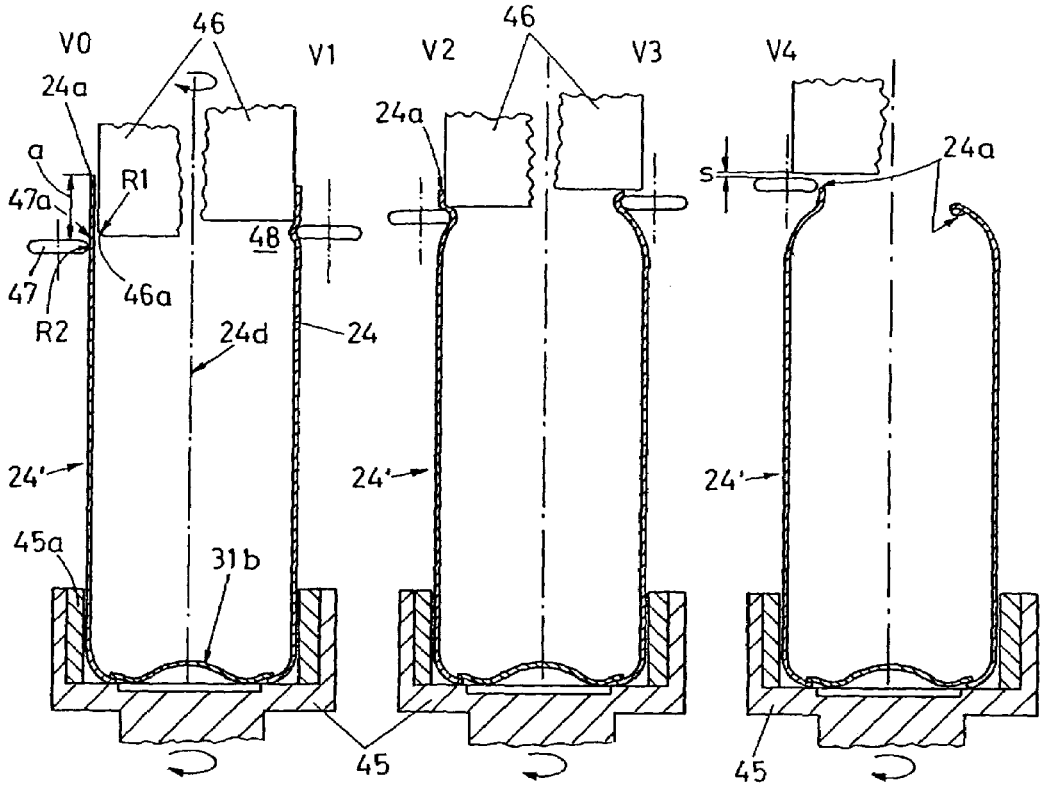
Figure 9D:
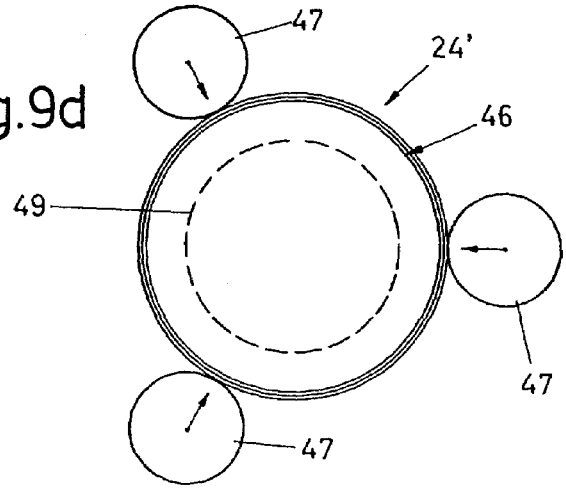

According to FIG. 9*d* preferably three forming rolls 47 are equally spaced in peripheral direction of the can body 24' and can be pressed together in radial inward direction up to a minimum can circumference 49. It will be understood that two or more than three forming rolls 47 may also be arranged. If only one forming roll 47 is provided, the occurring forming forces are unilateral which is particularly problematic towards the end of the forming procedure.

FIGS. 9*a*, 9*b* and 9*c* show the progress of a necking procedure referring to five situations V0, V1, V2, V3, V4 of an open can end necked more and more. At the beginning V0 of the necking procedure, the forming rolls 47 are spaced in axial direction by a distance a from the first face side. The support part 46 extends in the can's interior by an extension of an initial distance a minus the gap s. As soon as a small necking ring has been formed, as is illustrated about in situation V1, the can shell 24 obtains an increased stability against asymmetrical or undesirable deformations. With proceeding necking, as may be seen in situation V2, the first face side 24*a* is drawn more and more towards the deflection edge 46*a*, until it is only held in gap s, according to V3, and no longer according to V4. An end region at the first face side 24*a* is optionally formed in a pressing procedure subsequent to necking. An advantageous shape is illustrated in FIG. 12.

The described process and the described installation enable the efficient production of different can bodies and also of collapsible tubes. FIG. 10*a* shows an aerosol can 24', where a can bottom 31*b* is fixed by laser welding to the narrowed second face side 24*b* of the can shell 24. At the first face side 24*a*, an upper closure member 31*a* having a valve seat 50 is fixed by laser welding. The can bottom 31*b* and the upper closure member 31*a* may each be produced independently from the can shell 24. These separately produced parts may have different thicknesses of material and/or different material compositions which are optimized for their respective function. With a separately produced upper closure member 31*a*, a valve seat 50 of high quality may be ensured.

FIG. 10*b* shows an embodiment where the can shell 24 is specially formed by a shaping process. Since the material of the can shell 24 of a can body according to the invention is not hardened by an ironing process, known shaping process can be applied without any problem.

FIGS. 11*a* and 11*b* show can bodies 24' or collapsible tubes having, fixed inside and outside a can shell 24, a tube closure member 32 which comprises a thread 32*b* for a cap, not shown, around an output opening 32*a*.

FIG. 12 shows a detail of an upper closure member 31*a* that is connected to a can shell 24 by a welding seam 42, preferably a laser welding seam. The can shell 24 comprises, for example, an inner coating 5', and is beaded to the exterior at the first face side 24*a*. The upper closure member 31*a* comprises a metallic inner portion 51 and a plastic portion 52 which surrounds torically the inner portion 51 at least at the valve seat 50. The metal portion enables a welding seam 42. If the plastic portion 52 engages tightly the inner coating 5', it may be prevented, in some cases, that the contents of the can body contacts the metal layer.

According to FIG. 13, the plastic portion 52 enables insertion of a valve 53 without inserting a sealing 54 which was necessary according to the prior art. The plastic portion 52 has a thickened end rim, where a valve joining part may be surrounded and firmly clamped. Clamping pincers 54' may press tightly the joining rim of the valve 53 to the plastic portion 52. Since the metallic inner portion 51 does no longer need to be bend by 270°, production of the part 31*a* is much simplified. The metallic inner portion 51 may be provided with the plastic portion 52 by an injection molding step. This two-component closure member 31*a* is new and inventive, even independently from the can production process described.

FIG. 14 shows the lower end region of a can body 24', where the can bottom 31*b* is fixed to the second face side 24*b* by a welding seam 42. In order to cover the welding seam 42 and the inserted can bottom 31*b*, a base covering 55 is inserted. The base covering is preferably of plastic material and is fixedly sealed, for example, to the can bottom 31*b*. Optionally, the second face side 24*b* is formed or arranged on the can bottom 31*b* in such a manner that the base covering 55 can be fixed by press fitting. In the embodiment shown, the outer marginal area of the can bottom 31*b* is beaded to facilitate piling a can bottom staple. The rim of the can bottom 31*b* could also be beaded downwards to prevent, in the case of an inner coating, that the metallic marginal area 56 of the can bottom 31*b* contacts the contents of the can.

Figure 15A:
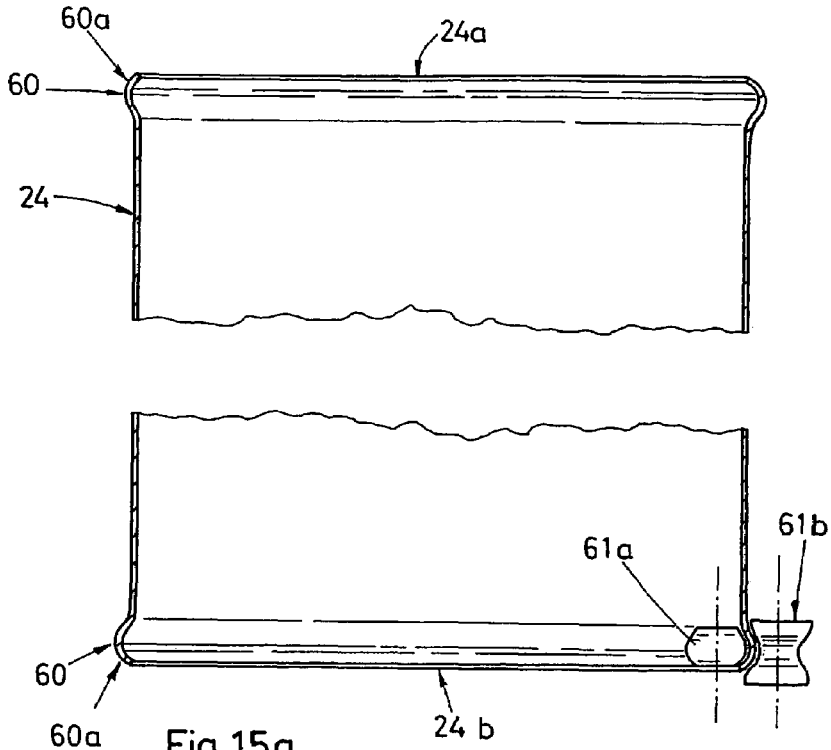

FIG. 15*a* shows a can shell 24 having annular buckles 60 which extend to the exterior in radial direction at both face sides 24*a* and 24*b*. At the buckles, a cross-sectional restriction is created towards the respective face side 24*a*, 24*b*. For forming the buckles 60, two forming rolls 61*a* and 61*b*, which fit together, are arranged at the outside and the inner side of the can shell 24. While the can shell 24 is turned passing the forming rolls 61*a* and 61*b*, the inner forming roll 61*a* may be pressed outwards and towards the outer forming roll 61*b*, until the desired buckle 60 has been formed. By a buckle 60, a shoulder 60*a* is established at at least one face side 24*a*, 24*b* of the can shell 24 without a necking step. Enlargements, in comparison to restrictions, can be produced with a good quality and substantially without problems. Thus, with a small expenditure, a shoulder 60*a* of a good quality is obtained.

Figure 15B:
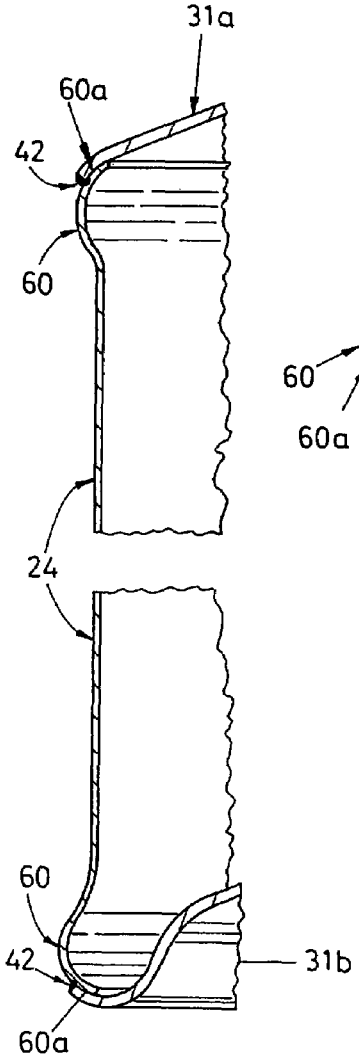

According to FIG. 15*b*, closure members, for example a can bottom 31*b* and an upper closure member 31*a*, are pressed against the shoulders 60*a* at the buckles 60. A firm and tight connection is formed by a connecting seam 42 in the form of a laser welding seam. Preferably, the can bottom 31*b* is welded first. Prior to or, optionally, after welding the upper closure member 31*a*, the can shell may be formed, for example by enlarging the can's cross-section at least to the diameter of the at least one buckle 60. Prior to welding the upper closure member 31*a*, forming tools, such as rolls, may be inserted into the can's interior for enlarging the can shell 24. Optionally, a fluid under pressure is introduced into the interior of a can for enlarging the can's cross-section, and the can shell 24 is pressed into an inner mold.

Figure 16:
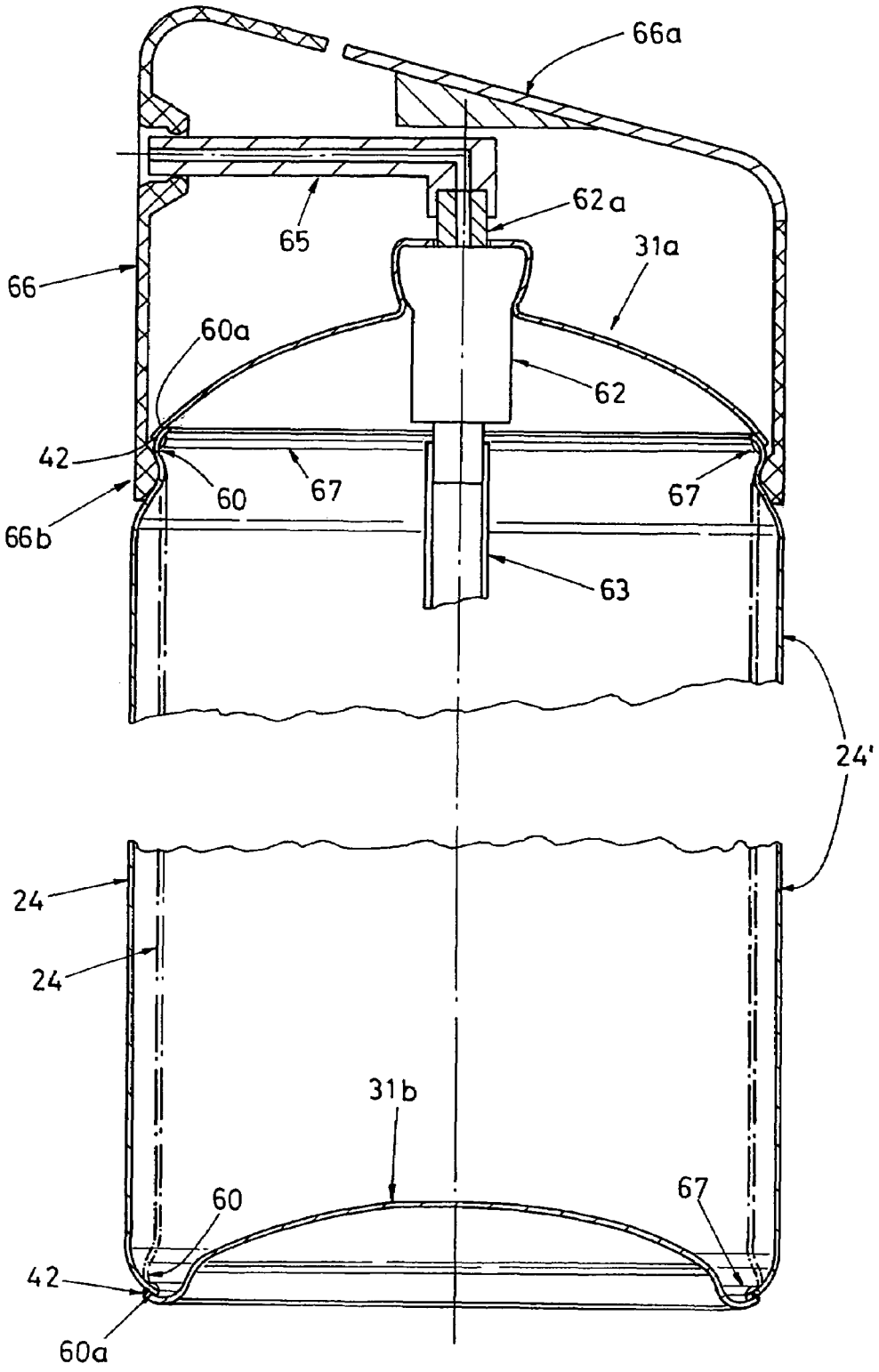

FIG. 16 shows an aerosol can 24' produced using a cylindrical can shell 24 with buckles 60. A can bottom 31*b* has been arranged at a lower shoulder 60*a*. The outer marginal region of the can bottom 31*b* is adapted to the shoulder 60*a* so that the outer rim of the can bottom 31*b* engages tightly the shoulder 60*a* when being compressed, thus enabling the formation of a precise and tight laser welding seam as a connecting seam 42. The can shell 24 is enlarged from a first cylindrical shape to a second shape before putting the upper closure member 31*a* on top. In this way, for example, some desired surface structures may be obtained. For enlarging the can shell 24, optionally forming tools, such as rolls, are inserted into the interior of the can. Preferably, however, a fluid under pressure is introduced into the interior of a can, and the can shell 24 is pressed into an inner mold which is known, for example, from Patent Nos. EP 853 513 B1, EP 853 514 B1 and EP 853 515 B1. The buckle 60 at the upper face side 24*a* is preferably left in its original shape so that a dome-shaped upper closure member 31*a* may be pressed against the shoulder 60*a*, and may be welded on by a connection seam 42.

The upper closure member 31*a* comprises a valve 62 from which a hose 63 extends to the can bottom 31*b*, and which can be actuated by a small output tube 62*a*. An output part 65 slipped onto the small output tube 62*a* is held in a cap 66. To actuate the valve 62, an actuation area 66*a* of the cap 66 is pressed onto the output part 65. In this way, the small output tube 62*a* is pressed downwards and, thus, the valve is opened. The cap 66 is held by a catch portion 66*b* in a corresponding catch shape of the can shell 24. The catch shape of the can shell 24 is optionally formed by the buckle 60 or by a restricted region between the buckle 60 and the enlarged region of the can shell 24. Optionally, the catch shape may also be formed by the outer rim of the upper closure member 31*a* or by the connecting seam 42.

The cap 66 covers the upper closure member 31*a* and, together with the can shell 24 which preferably comprises a decorative film, ensures an attractive appearance which corresponds to that of a one-piece aluminum can. Embodiments are also possible in which the can shell 24 and the can bottom are integrally formed, or in which the connecting seam 42 between the can shell 24 and the can bottom 31*b* is covered by a base covering. Even if the connecting seam 42 is visible at the can bottom, as a thin laser welding seam it is hardly perceivable. To prevent oxidation of the connecting seam 42, it is optionally sealed by a coating.

To ensure a continuous inner coating also in the can's interior, the can shell 24, the can bottom 31*b* and the upper closure member are provided inside with a protective layer in the form of a film or of a coating. Optionally sealing material 67 is arranged in an annular shape at the connecting seams 42 so as to ensure also a continuous sealing layer after making the connecting seams 42. In order that coatings do not interfere with the laser welding, the interengaging portions in the region of the laser seam may be treated by a laser for removing the coating prior to laser welding. The inner coating is thereby not affected.

Figure 17:
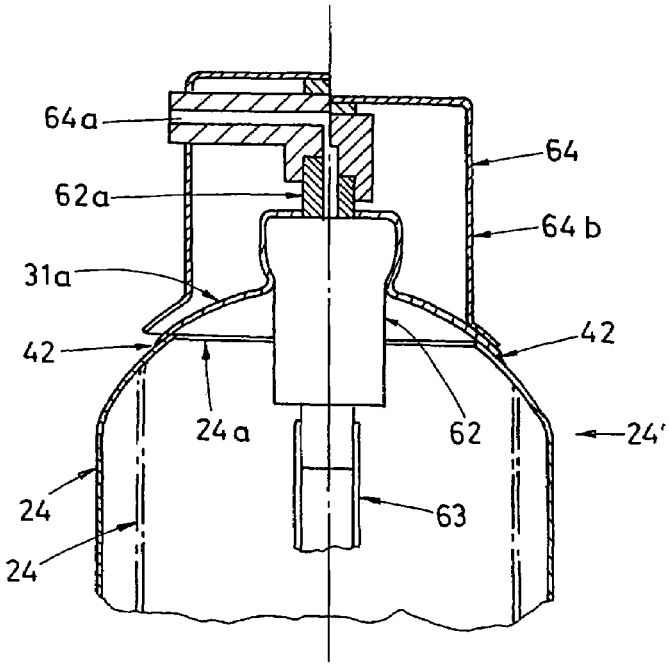

FIG. 17 shows the upper portion of an aerosol can 24', wherein the can shell 24, at a necked face side 24*a*, is connected to a dome-shaped upper closure member 31*a* by the connecting seam 42. The can shell 24 is optionally enlarged from a first cylindrical shape to a second shape before putting the upper closure member 31*a* on top. In this way, for example, some desired surface structures may be obtained. The closure member 31*a* comprises a valve 62 from which a hose 63 extends to the can bottom 31*b*, and which can be actuated by a small output tube 62*a*. A spraying head 64, slipped over the small output tube 62*a*, comprises a discharge channel 64*a* and a cap 64*b*. The cap 64*b* extends radial outwards and axially towards the upper closure member 31*a* preferably so far that the connecting seam 42 is substantially covered so that the upper closure member 31*a* is not visible. Of the aerosol can 24' appear only the can shell, that comprises a decorative layer, and the spraying head 64.

Independently from the precise form of the welded parts, welding the upper closure member 31*a*, including the valve 62, is very advantageous. By welding the upper closure member 31*a*, micro-leakages are excluded. Filling the aerosol can 24' is effected prior to putting on the spraying head 64 through the discharge tube 62*a*.

Figures 18A, 18B, 18C, 19, 19A, 19B, 20, 21:
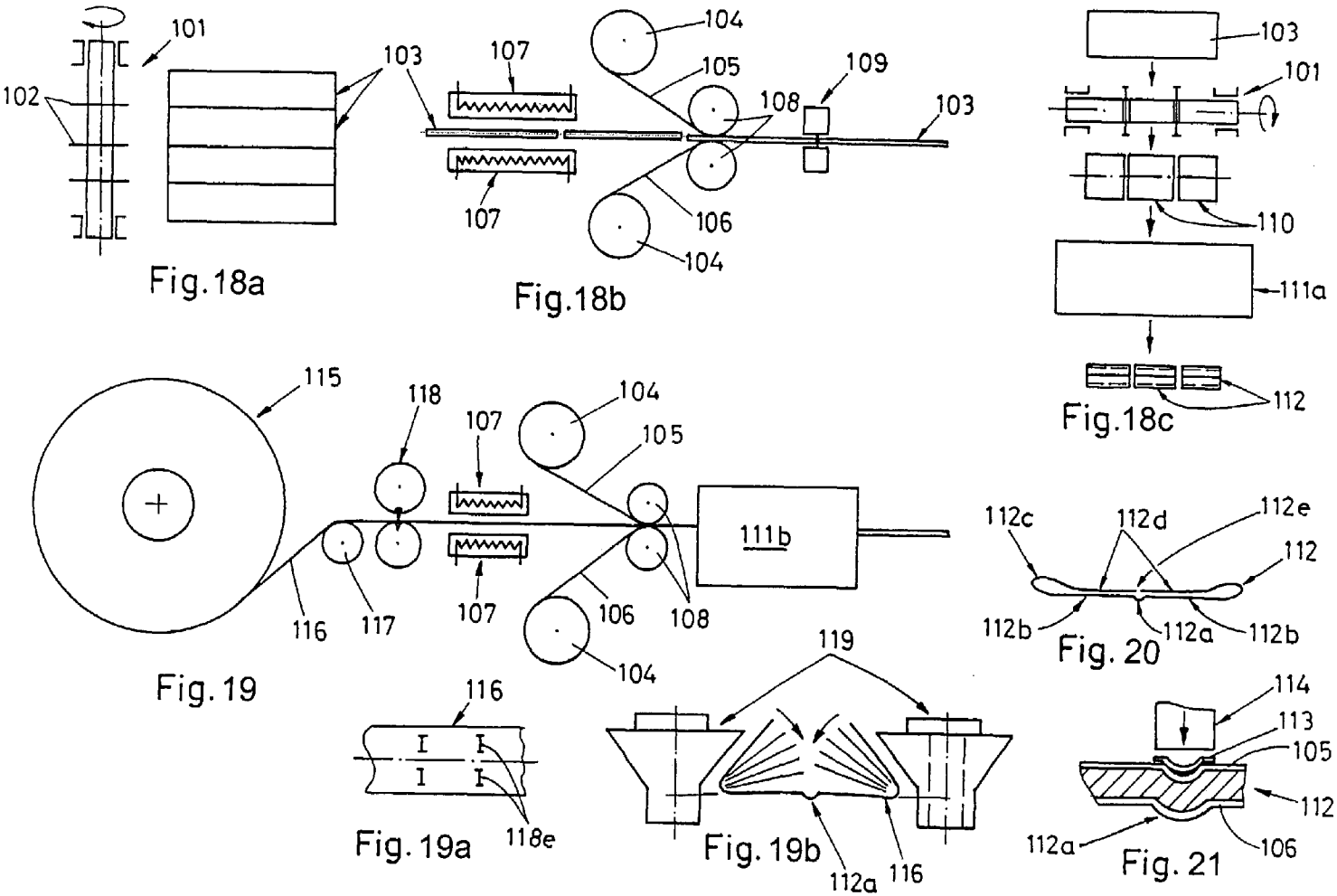

FIG. 18*a* shows a severing device 101 in the form of a rotating shaft, supported on both sides, which has severing elements 102. The severing elements 102 may be positioned in spaces from one another which are assigned to the desired can circumference. If plates of flat material of a metal are conveyed through the severing device 101, strips 103 are formed having a width in the range of the can's circumference and a length of at least one can shell height.

FIG. 18*b* shows a device for applying films on both sides of the strips 103. The strips 103 are moved along a treatment axis substantially immediately joining each other. Above the strips 103, a coil 104 of the decorative film 106 is located. The strips 103 are heated by a heating device 107 up to a temperature that is necessary for sealing the films 105, 106. Two pressing rolls 108 and a respective sealing layer on the films 105 and 106 ensure a firm connection of the films 105 and 106 to the strips 103. In order to enable further treatment separately of the coated strips, a film cutting device 109 is provided which separates the films 105 and 106 between the strips 103 either mechanically or, optionally, by heat.

FIG. 18*c* shows a part of the installation which cuts the strips 103 into sections 110 by means of a severing device 101, and which forms them in a first forming device 111*a* into flat pressed can shells 112.

In the embodiment according to FIG. 20, the flat pressed can shell 112 has a recess 112*a* in the region of the center line, two flat center regions 112*b* at both sides of it, an adjacent curved region 112*c*, and two flat marginal regions 112*d* which can be pressed onto the flat center regions 112*b*. At the compressed sides 112*e*, the can shell is closed by means of laser welding.

According to FIG. 21, a covering tape 113 is arranged in the region of the recess 112*a* of the flat pressed can shell 112. The covering tape 113 is applied by a supply device 114 onto the inner film 105, preferably immediately after or together with supplying the inner film 105.

FIG. 19 shows an embodiment in which the flat pressed can shells 112 are continuously formed as a strip material, and are subsequently welded so that severing of individual can shells 112 is carried out only at the end. From a coil of flat material 115, strip-like flat material 116 is fed to an incision device 118 by a supply device 117. The incision device 118 forms two incisions 118*e* perpendicular to the strip's axis on the strip-like flat material. When forming into the flat pressed shell shape, these incisions 118*e* reach the two curved regions 112*c* so that, when severing can shell section, severing the flat material is only necessary in the flat region between the radii of curvature. If severing had also to be done in the regions of curvature, plies would develop during severing which could not be completely flattened.

In the subsequent device, films are applied to both sides of the flat material 116. The strip-like flat material 116 is moved along a treatment axis. Above the flat material 116, a coil 104 of an inner film 105 is located, and below the flat material 116 is a coil of the decorative film 106. The flat material 116 is heated by a heating device 107 up to a temperature that is necessary for sealing the films 105, 106. Two pressing rolls 108 and a respective sealing layer on the films 105 and 106 ensure a firm connection of the films 105 and 106 to the flat material 116.

By a second forming device 11*b*, the flat material 116, coated on both sides, is formed continuously and transversely to the strip axis into a flat pressed, closed shape whose cross-section corresponds to the embodiment according to FIG. 20. The second forming device 111*b* comprises, for example, pairs of rolls one after the other which bend the lateral marginal regions of the flat material 116 more and more towards the center. FIG. 19*b* shows an example of a pair of rolls 119. Prior to bending the lateral marginal regions, the recess 112*a* is formed in the middle of the flat material 116 by means of a cooperating pair of rolls.

Figure 18D:
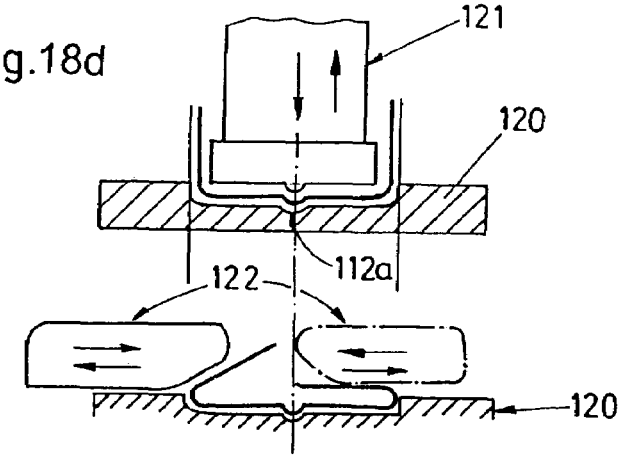

According to FIG. 18*d*, flat material in the form of sections receives a U-shape and a recess 112*a* by a first forming device using a forming mold 120 and a complementary first forming tool 121. By means of two laterally acting further forming tools 122, the lateral marginal regions are completely bent. To press the center region flat, one presses onto the shell section another time with a first forming tool, not shown, having no recess projection and a smaller width.

Laser welding the can's longitudinal seam is effected on the flat pressed can shell strip the same way as on the individual can shells. The individual can shells are preferably fed to a welding device, while immediately joining each other, so that the welding device is able to form the welding seam substantially continuously in a similar way as with a can strip.

Figure 22:
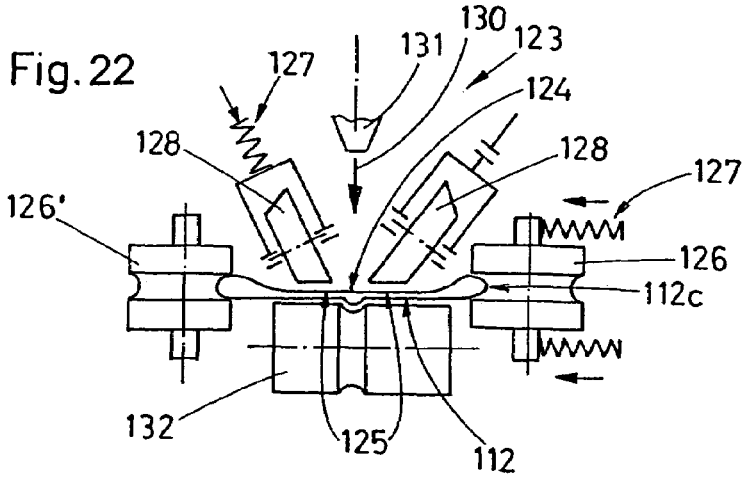
Figure 23:
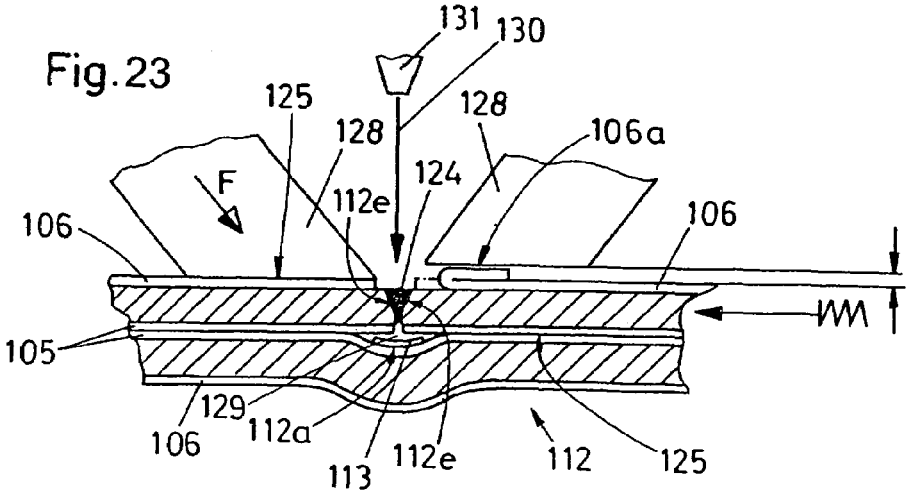

FIGS. 22 and 23 show a first welding device 123 for laser welding the can's longitudinal seam 124 at the compressed sides 112*e* of a flat pressed can shell 112. The lateral marginal regions 125 to be interconnected of the flat material are supported each at both sides of the recess 112*a* on a flat center region of the inner rim of the can shell, which acts as a partial guiding surface 112*b*. In the embodiment illustrated, the two partial guiding surfaces 112*b* are formed on the inner side of the can shell.

The can shell 112 has a closed, flat pressed shape, the inter engaging partial surfaces being interconnected by curved regions 112*c* when welding. One marginal region 125 is pressed against the other marginal region 125 by one of the two lateral pressing rolls 126 by means of a pressing device 127 so that compressing the sides 112*a* is ensured. In order to be able to hold the two marginal regions 125, pressed in common against a stop, on partial guiding surfaces 112*b*, holding rolls 128 are arranged in such a manner that they hold the two marginal regions 125 at the sides 112*e* on the partial guiding surfaces 112*b*. One of the two holding rolls 128 is pressed by a pressing device 127 against one of the marginal regions 125. The flat pressed can shell 112 is supported by a supporting roll 132 in the region of the holding rolls 128. The other holding roll 128 is held by an adjusting device at an adjustable distance to the other marginal region 125. Welding is achieved by a laser beam 130 from a laser source 131.

To prevent an affection of the decorative film 106 when welding the longitudinal seam 124, the decorative film 106 may be arranged on the flat material 116, 103 in such a manner that it does not reach up to the side 112*e* with one of its marginal regions 125, but projects at the other marginal region 125 beyond the side 112*e*. The projecting film area 106*a* is not sealed to the flat material 116, 103 in a marginal region thereof so that this free film margin 106*a* may be bend from the region of the longitudinal seam 124 prior to forming this longitudinal seam 124. After the welding procedure, the free film margin 106*a* may be put over the longitudinal seam 124 and may, according to FIG. 25, be sealed. In this way, the longitudinal seam 124 is completely covered.

Any inner film 105 that is damaged in the region of the welding seam 124 is covered by the covering tape 113 so that complete corrosion protection is ensured. A small free space 129 between the sides 112*e* and the covering tape 113 ensures that it is not affected by welding. After the welding procedure, the recess 112*a* with the covering tape 113 may be pressed against the welding seam 124 and may be fixed there in such a way that it is firmly sealed at both sides to the intact inner film 105. Since the covering tape does not comprise a sealing layer at the side facing the inner film 105 at the recess 112*a*, it may be transferred at the longitudinal seam 124 to the inner film 105.

Figure 24:
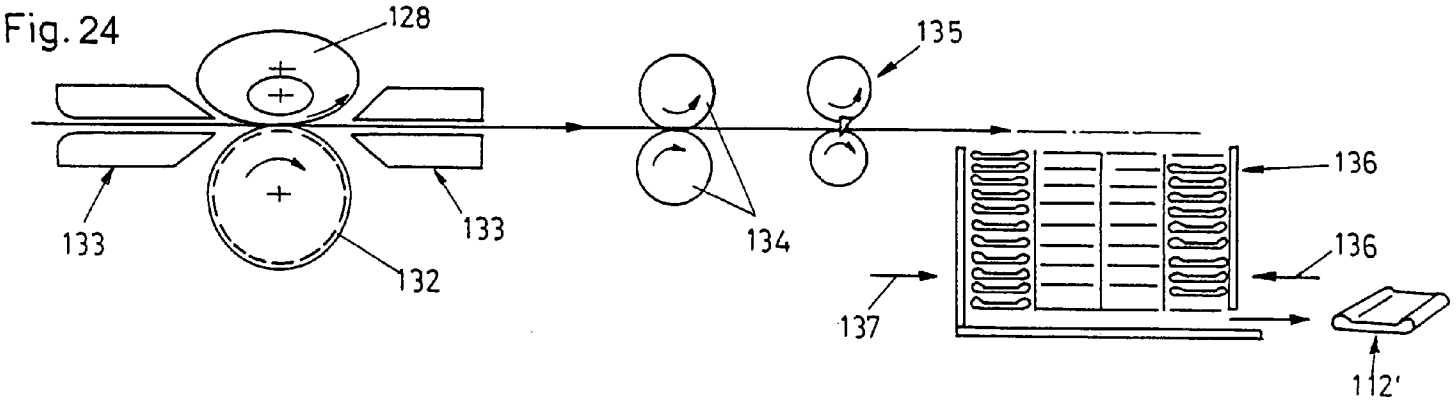
Figure 25:
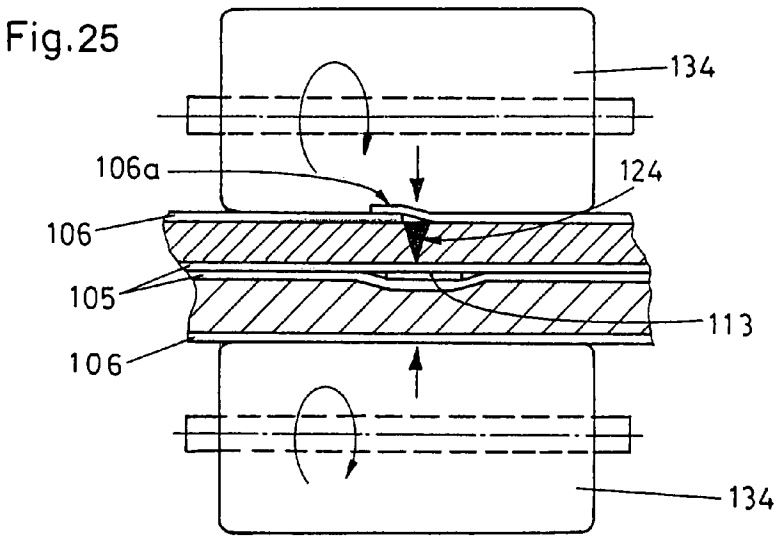

FIG. 24, apart from the holding roll 128 and the supporting roll 132, shows guiding devices 133. Firmly sealing the projecting film area 106*a* and the covering tape 113, illustrated in FIG. 25, is achieved by two press rolls 134. The heat necessary for sealing stems, in some cases, from the longitudinal seam 124, or is supplied from outside. In an installation with a strip of a can shell, the can shell sections are severed in a severing device 135, preferably comprising rotating cutting edges. The closed, flat pressed can shells 112' are fed, for example, at top into a conditioning device 136, where they are maintained warm for such a length of time, as is necessary for a lasting connection between the metallic flat material and the decorative film 106 or the inner film 105. The closed, flat pressed can shells 112' discharged at the bottom may be used for producing can bodies either directly, after some storage or after transport.

It will be understood that the features described in the context of different embodiments may be combined, and that the described novel and inventive approaches may be claimed even independently from the present claims. Even if a can shell has not been produced as a tubular section, the described novel necking process and the novel upper closure member comprising a metallic inner portion 51 and a plastic portion 52 to which a valve is clamped is new and inventive. Likewise, welding a closure member 31*a* having a valve 62 as well as the aerosol can thus produced is new and inventive independently from the process by which the can shell 24 is manufactured.

The invention claimed is:

1. Method for the production of a can body with a closed can shell and at least one closure member arranged on the can shell, comprising:

forming a metal strip to a tube closed in peripheral direction;

laser welding a longitudinal seam in between lateral edges of the tube shaped metal strip substantially continuously in longitudinal direction of the tube;

severing tube sections of the obtained tube, wherein each of the sections have the length of a desired can height and include face sides formed by front sides at edges on ends of each of the sections;

forming the sections to can shells with at least one cross-sectional restriction from an enlarged cross-section to a smaller cross-section at least at one face side of the can shells, the face side of the can shell formed by a front side at an edge on an end of the can shells; and attaching a closure member in the form of a can bottom to said at least one restriction of each can shell by laser welding a circumferential seam, wherein an outer marginal region of the can bottom is adapted to the shape of said restriction and a marginal face side of the bottom is a marginal edge of the bottom, and for attaching the bottom to the can shell, the marginal face side of the bottom and the face side of the can shell at the bottom are on opposite sides of the can body, wherein one of the marginal face side of the bottom and the face side of the can shell at the bottom is inside of the can and the other one of the marginal face side of the bottom and the face side of the can shell at the bottom is outside of the can.

2. Method according to claim 1, wherein the longitudinal seam is welded on the tube shaped metal strip in a flat pressed shape wherein lateral marginal regions to be interconnected at the lateral edges are in supporting contact to the inner side of the can shell.

3. Method according to claim 1, wherein for forming the tube the metal strip is moved in its longitudinal direction through a forming device and is passed next to a welding device, the forming device forming the metal strip continuously in such a way that the two lateral edges contact each other, and the welding device interconnects these lateral edges by said longitudinal welding seam.

4. Method for the production of a can body with a closed can shell having a longitudinal welding seam extending over the entire height of the can shell and with at least one closure member arranged on the can shell, comprising:

cutting a metal strip into sections, forming the sections into a closed flat pressed shape by means of a forming mold and forming tools, putting the flat pressed sections in series, joining directly to each other, laser welding a longitudinal seam in between lateral edges of the joining, flat pressed sections substantially continuously in longitudinal direction along the joining, flat pressed sections, severing tube sections, each of which have the length of a desired can height and include face sides formed by front sides at edges on ends of the sections;

forming the tube sections to can shells with at least one cross-sectional restriction from an enlarged cross-section to a smaller cross-section at least at one face side of each of the can shells, the face side of the can shell formed by a front side at an edge on an end of the can shells; and attaching a closure member in the form of a can bottom to said at least one restriction of each can shell by laser welding a circumferential seam, wherein an outer marginal region of the can bottom is adapted to the shape of said restriction and a marginal face side of the bottom is a marginal edge of the bottom, and for attaching the bottom to the can shell, the marginal face side of the bottom and the face side of the can shell at the bottom are on opposite sides of the can body, wherein one of the marginal face side of the bottom and the face side of the can shell at the bottom is inside of the can and the other one of the marginal face side of the bottom and the face side of the can shell at the bottom is outside of the can.

5. Method according to claim 1, wherein a decorative film is applied to the outer side of the metal strip.

6. Method according to claim 1, wherein a first film strip is put on the flat metal strip in a longitudinal direction of the metal strip, and is fixed by way of a sealing connection to form an inner protective layer.

7. Method according to claim 1, wherein for severing the tube sections, a cutting procedure is carried out with a cutting edge, the cutting edge, during the cutting procedure, being moved together with the arising laser welded tube shaped metal strip and being reset after having severed a tube section.

8. Method according to claim 7, wherein on the flat metal strip incisions are formed which after forming and pressing flat are arranged in curved regions between flat regions, the cutting procedure being carried out in the flat regions between the incisions.

9. Method according to claim 1, wherein can shells are shaped by a shell forming device in such a way that a circular cylindrical cross-section is obtained.

10. Method according to claim 9, wherein at least one face side of the can shell with the circular cylindrical cross-section an annular buckle is formed radially outwards thereby creating the cross-sectional restriction towards the face side at the buckle.

11. Method according to claim 1, wherein said at least one restriction is a shoulder-shaped restriction.

12. Method according to claim 1, wherein the at least one cross-sectional restriction is formed at an upper face side of the can shell, and an upper closure member is tightly connected to the restriction at the upper face side of the can shell by laser welding a circumferential seam, wherein the outer marginal region of the closure member is adapted to the shape of said restriction.

13. Method according to claim 12, wherein the can body is held in two regions, in a first region by a first holder so that it may be rotated about its longitudinal axis by the first holder, while the second region is situated at the can end to be necked where the can body is held by a co-rotating second holder, which comprises a support part displaceable relative to the can body, having an annular deflection edge, wherein forming is achieved by at least one deforming surface joining the deflection edge at a distance in axial direction and being adapted to be pressed towards the interior in radial direction, a free space being provided radial inside the deforming surface in the interior of the can so that nothing obstructs a deformation of the can shell towards the interior.

14. Method according to claim 12, wherein an annular buckle is formed at each of the two face sides of the can shell in radial outward direction, while the can shell comprises a cross-sectional restriction at the buckles towards the respective face side, and that at the restrictions the can bottom and the upper closure member are attached by laser welding.

15. Method according to claim 1, wherein a base covering is fixed in such a manner that the connection of the can shell to the can bottom is covered by the base covering.

16. Method according to claim 1, wherein an upper closure member together with a valve is attached to the can shell by laser welding.

17. Method according to claim 1, further comprising at least one necking step, wherein a can body to be necked, which extends along an axis, is held in two regions, the can body being firmly held by a first holder in the first region so that it may be rotated about its longitudinal axis by the first holder, while the second region is situated at the can end to be necked where the can body is held by a co-rotating second holder, which comprises a support part displaceable relative to the can body, having an annular deflection edge, and a deformation is achieved by at least one forming surface joining the deflection edge at a distance in axial direction and being adapted to be pressed towards the interior in radial direction, a free space being provided radial inside the deforming surface in the interior of the can so that nothing obstructs a deformation of the can shell towards the interior.

18. Device for the production of a can body with a closed can shell and at least one closure member arranged on the can shell, comprising:

a supply arrangement for supplying a metal strip;

a first forming device for forming the metal strip into the shape of a tube closed in peripheral direction;

a welding device for substantially continuously welding the tube;

a severing device separating closed can shells from the tube, wherein the can shells include edges on ends and face sides formed by front sides of the edges;

a second forming device for forming the sections to can shells with a cross-sectional restriction from an enlarged cross-section to a smaller cross-section at least at one face side of the can shells, the face side of the can shell formed by a front side at an edge on an end of the can shells; and an attaching device for attaching a closure member in the form of a can bottom to said at least one restriction of each can shell by laser welding a circumferential seam, wherein an outer marginal region of the can bottom is adapted to the shape of said restriction and a marginal face side of the bottom is a marginal edge of the bottom, and said attaching device brings together the bottom and the can shell in such a way, that the marginal face side of the bottom and the face side of the can shell at said bottom are on opposite sides of the can body, wherein one of the marginal face side of the bottom and the face side of the can shell at the bottom is inside of the can and the other one of the marginal face side of the bottom and the face side of the can shell at the bottom is outside of the can.

19. Device according to claim 18, wherein the first forming device forms the metal strip continuously around an axis extending parallel to the metal strip in such a manner that the two lateral edges contact each other, and that the welding device connects these lateral edges by a longitudinal welding seam, and that the severing device comprises a cutting edge that is optionally moved during the cutting procedure together with the arising tube and is reset after having severed a tube section.

20. Device according to claim 18, wherein the welding device is formed and arranged in such a way that it enables welding of a butt-joint or a jump joint welding seam on a flat pressed tube while the lateral marginal regions to be interconnected are supported on the inner side of the can shell.

21. Can body including a can shell, wherein the can shell comprises a metal strip closed in a peripheral direction by a longitudinal laser welding seam and the can shell includes face sides formed by front sides at edges on ends of the can shell, and a bottom fixed at one face side of the can shell, wherein the can shell has a cross-sectional restriction from an enlarged cross-section to a smaller cross-section at least at one face side of the can shell, the face side of the can shell formed by a front side at an edge on an end of the can shells; and a closure member in the form of a can bottom is attached to said at least one restriction of each can shell by a circumferential laser welding seam, wherein an outer marginal region of the can bottom is adapted to the shape of said restriction, a marginal face side of the bottom is a marginal edge of the bottom, and the face side of the can shell and the marginal face side of the bottom attached at said face side of the can shell are on opposite sides of the can body, one of the marginal face side of the bottom and the face side of the can shell at the bottom is inside of the can and the other one of the marginal face side of the bottom and the face side of the can shell at the bottom is outside of the can.

22. Can body comprising a closed can shell, the can shell including face sides formed by front sides at edges on ends of the can shell, and a closure member fixed at one face side of the can shell wherein the can shell has a cross-sectional restriction from an enlarged cross-section to a smaller cross-section at least at one face side of the can shell, the face side of the can shell formed by a front side at an edge on an end of the can shells;

the closure member is attached to said at least one restriction of the can shell by a circumferential laser welding seam, wherein an outer marginal region of the closure member is adapted to the shape of said restriction, a marginal face side of the closure member is a marginal edge of the closure member, and the face side of the can shell and the marginal face side of the closure member attached at said face of the can shell are on opposite sides of the can body, one of the marginal face side of the closure member and the face side of the can shell at the closure member is inside of the can and the other one of the marginal face side of the closure member and the face side of the can shell at the closure member is outside of the can; and the closure member including a valve seat with a metallic inner portion as well as a plastic portion which surrounds torically the metallic inner portion at least at the valve seat.

23. Can body comprising a closed can shell, the can shell including face sides formed by front sides at edges on ends of the can shell, and an upper closure member fixed at one face side of the can shell wherein the upper closure member is including a valve;

the can shell has a cross-sectional restriction from an enlarged cross-section to a smaller cross-section at least at one face side of the can shell, the face side of the can shell formed by a front side at an edge on an end of the can shells; and the closure member with the valve is attached to said at least one restriction of the can shell by a circumferential laser welding seam, wherein an outer marginal region of the closure member is adapted to the shape of said restriction, a marginal face side of a closure member is a marginal edge of the closure member, and the face side of the can shell and the marginal face side of the closure member attached at said face of the can shell are on opposite sides of the can body, one of the marginal face side of the closure member and the face side of the can shell at the closure member is inside of the can and the other one of the marginal face side of the closure member and the face side of the can shell at the closure member is outside of the can.

24. Can body according to claim 21, wherein the can shell has a cross-sectional restriction at both faces, further comprising a upper closure member at the upper face opposite to the closure member, wherein the upper closure member is connected to the restriction at the upper face of the can shell by a circumferential laser welding seam, and the outer marginal region of the upper closure member is adapted to the shape of said upper restriction.

25. Can body according to claim 24, wherein the face side of the can shell and the face side of the upper closure member attached at said face of the can shell are on opposite sides of the can body, one inside and one outside of the can.

26. Method according to claim 1, wherein the longitudinal welding seam is formed as a butt-joint or a jump joint.

27. Method according to claim 6, wherein a seam covering tape is put on the film strip and made to engage the region of the welding seam after the welding step.

28. Method according to claim 9, wherein forming the can shell includes increasing the circumference of the can shell and creating a cross-sectional restriction from an enlarged one to a smaller cross-section at one can end.

29. Method according to claim 12, wherein for attaching the upper closure member to the can shell, the face side of the upper closure member and the face side of the can shell at the upper closure member are on opposite sides of the can body, one inside and one outside of the can.

30. Device according to claim 18, wherein said second forming device for forming the sections to can shells is forming cross-sectional restrictions at both faces of the can shells and said attaching device is attaching an upper closure member at the can shell by laser welding a circumferential seam, wherein the outer marginal region of the upper closure member is adapted to the shape of the restriction at the upper can shell end, and the face side of the upper closure member and the face side of the can shell at said upper closure member are on opposite sides of the can body, one inside and one outside of the can.

* * * * *